US006179593B1

(12) United States Patent
Mitsuya et al.

(10) Patent No.: US 6,179,593 B1
(45) Date of Patent: Jan. 30, 2001

(54) DISPLACEMENT FLUID MACHINE

(75) Inventors: Shunichi Mitsuya; Hirokatsu Kohsokabe, both of Ibaraki-ken; Masahiro Takebayashi, Tsuchiura; Koichi Inaba; Hiroaki Hata, both of Tochigi-ken; Kenji Tojo, Ibaraki-ken, all of (JP)

(73) Assignee: Hitachi, Ltd., Tokyo (JP)

( * ) Notice: Under 35 U.S.C. 154(b), the term of this patent shall be extended for 0 days.

(21) Appl. No.: 09/044,169

(22) Filed: Mar. 19, 1998

(30) Foreign Application Priority Data

Mar. 19, 1997 (JP) ..... 9-066075

(51) Int. Cl.[7] ..... F01C 1/02
(52) U.S. Cl. ..... 418/61.1; 418/94
(58) Field of Search ..... 418/61.1, 94

(56) References Cited

U.S. PATENT DOCUMENTS 2,112,890 10/1938 Gunn .
3,909,161 * 9/1975 Stenner ..... 418/61.1 X
3,981,641 * 9/1976 D'Amato ..... 418/61.1
4,005,951 * 2/1977 Swinkels ..... 418/61.1
5,597,293 1/1997 Bushnell .

FOREIGN PATENT DOCUMENTS 2164331 7/1973 (FR) .
398678 4/1938 (GB) .

* cited by examiner

*Primary Examiner*—Hoang Nguyen
(74) *Attorney, Agent, or Firm*—Antonelli, Terry, Stout & Kraus, LLP

(57) ABSTRACT

Side wall surface of an orbiting piston and inner wall surface of a cylinder define therebetween a plurality of working chambers, a space for compressing (discharging) a working fluid is defined between spaces for sucking thereinto the working fluid among the working chambers in any operating condition, and one of end plates, between which the orbiting piston is axially interposed, is formed with suction ports or discharge ports while the other of end plates, opposing the end plate formed with the suction or discharge ports, is formed with holes, whereby it is possible to provide a highly efficient and reliable displacement fluid machine which can stabilize pressure balance in the working chambers, and which can greatly reduce fluid loss during discharge stroke.

6 Claims, 18 Drawing Sheets

1
2
3
4a
5a
6
7
a
b
c
d
e
f
O
O'
ω

27
29
29d
29g
30
30a
31
31d
32b
33
33b
33d
34
a
b
c
d
e
f
O
O'
O1
O1'

DISPLACEMENT FLUID MACHINE

BACKGROUND OF THE INVENTION

The present invention relates to a displacement fluid machine such as pumps, compressors or expansion machines.

Heretofore, there have been known, as a displacement type fluid machine, a reciprocating fluid machine, in which repeated reciprocation of a piston in a circular cylinder displaces a working fluid, a rotary type (rolling piston type) fluid machine, in which a cylindrical piston eccentrically rotates in a circular cylinder to displace a working fluid, and a scroll type fluid machine, in which a pair of stationary and orbiting scrolls with spiral laps arranged upright on end plates engage with each other to cause the swirl scroll to perform orbital movements to displace a working fluid.

The reciprocating fluid machine is advantageous in that it is simple in construction and so easy to manufacture and inexpensive. However, a stroke from the completion of suction to the completion of discharge is as short as 180 degrees in terms of a shaft rotating angle and so a flow rate is high during discharge stroke, resulting in a problem of degradation in performance due to increase in pressure loss. Further, in the reciprocating fluid machine, its rotary shaft system cannot completely be balanced since reciprocating motion of a piston is required, resulting in a problem of great vibration and noise.

Further, as compared with the reciprocating fluid machine, the rotary type fluid machine, in which a shaft rotating angle during a period from the completion of suction to the completion of discharge is as long as 360 degrees, is less problematic in an increased pressure loss during the discharge stroke but discharges once every shaft revolution to involve a relatively large variation in gas compression torque, which results in a problem of occurrence of vibrations and noises, as in the reciprocating fluid machine.

Further, having a shaft rotating angle of as large as 360 degrees or more (normally in the order of 900 degrees for ones practiced as air-conditioning use) during a period from the completion of suction to the completion of discharge, is greater than 360 degrees (that of those which have been practically used for air-conditioning is normally about 900 degrees), the scroll type fluid machine involves a less pressure loss during discharge stroke, and generally comprises a plurality of working chambers, so that variation in gas compression torque is small, and so vibrations and noises are low. However, since the management for a clearance between spiral laps in a lap engagement state, and for a clearance between laps and end plates is required, a process having a high degree of accuracy is required, and as a result, and accordingly, a problem of increasing the cost of the process. Further, since the shaft rotating angle during a period from the completion of suction to the completion of discharge is larger than 360 degrees so as to be too long, the time of stroke is long so as to raise a problem of increasing internal leakage.

By the way, Japanese Patent Unexamined Publication No. 55-23353 proposes a kind of displacement type fluid machine in which a displacer (orbiting piston) for displacing the working fluid revolves or orbits with a substantially constant radius without self-rotation, relative to a cylinder having been charged therein with the working fluid, in order to displace the working fluid. This proposed displacement fluid machine is composed of a piston having a petal shape in which a plurality of members (vanes) radially extending from the center of the piston, and a cylinder having a hollow portion which defines a gap equal to an orbit radius between the outer periphery of the piston and the inner periphery of the cylinder when the piston and the cylinder are set to be concentric with each other, the piston orbiting in the cylinder so as to displace the working fluid.

The displacement fluid machine disclosed in the Japanese Patent Unexamined Publication No. 55-23353 dose not have reciprocating portions as in the reciprocating fluid machine, and accordingly, the rotary shaft system can be completely balanced. Thus, this does not cause so much vibration, and further, the relative slipping speed between the piston and the cylinder is low so as to relatively decrease the frictional loss, that is, this machine has an advantage inherent to the displacement fluid machine.

However, the behavior of the piston is unstable during operation, and accordingly, it causes a problem of increased vibrations and noises and an increased leakage of the working fluid, which lead to degradation in performance.

Further, the passage area during suction stroke and discharge stroke, which is defined by a suction port and a discharge port in the compression working chamber, and the orbiting piston, varies depending upon a rotating angle of the shaft of the piston, and accordingly, it is hard to ensure the suction passage and the discharge passage which are necessary and sufficient, causing a problem of degraded performance.

SUMMARY OF THE INVENTION

An object of the present invention is to provide a displacement fluid machine which can ensure stable behavior for an orbiting piston and which can attain an improvement in performance and reliability.

To the end, according to the present invention, there is provided a displacement fluid machine in which a displacer and a cylinder are interposed between end plates, and a space is defined between the inner wall surface and the outer wall surface of the displacer when the center of the displacer is aligned with the rotary center of a rotary shaft while a plurality of spaces are defined when the positional relationship between the displacer and the cylinder is set to the orbit center, comprising a means for orbiting the displacer between the end plates through the intermediary of lubricating oil.

Specifically, the means for orbiting the displacer between the end plates through the intermediary of lubricating oil, is composed of a means for feeding lubricating oil into those surfaces of the displacer which faces the end plates, at least one of an hole formed in the end plate facing the end plate formed therein with a suction port at a position which faces suction port, and an hole formed in the end plate facing the end plate formed therein with a discharge port at a position which faces the discharge port.

Figure 1:
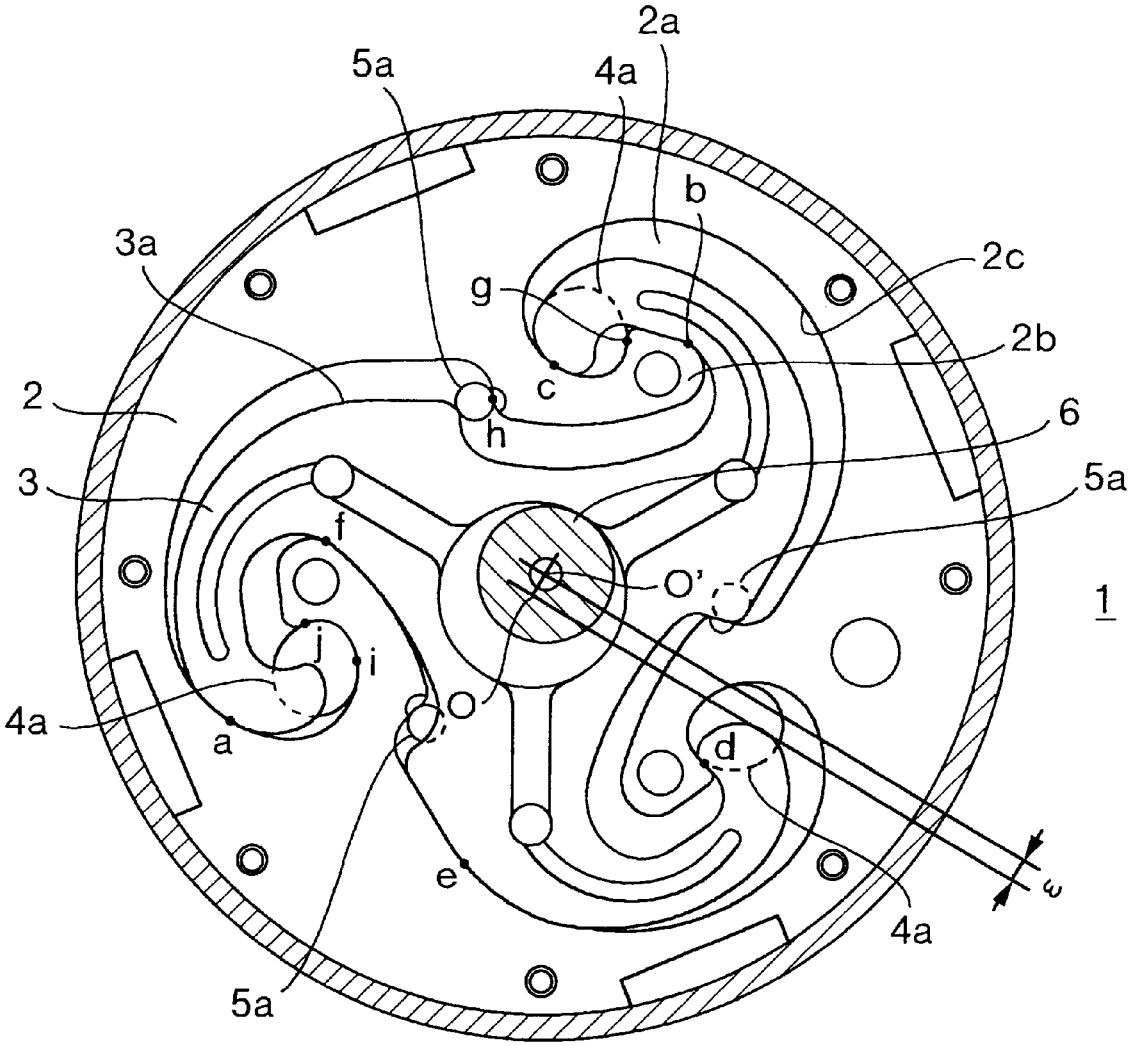
FIG. 1 is a plan view illustrating an orbiting type compression element according to an embodiment of the present invention.
Figures 2A, 2B, 2C, 2D:
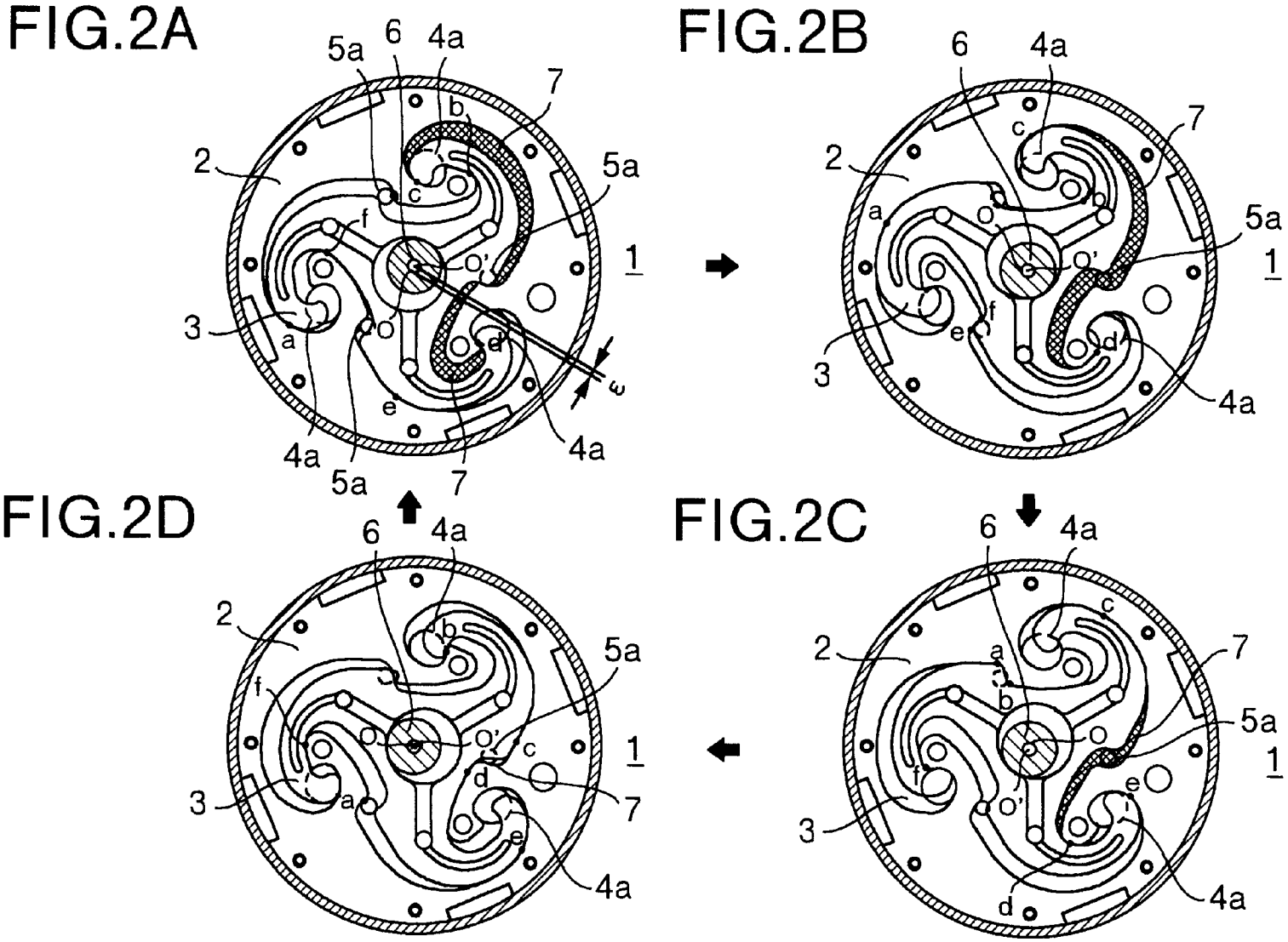
FIGS. 2A to 2D are plan views showing operational principles of the orbiting type compression element in the embodiment of the present invention.
Figure 3:
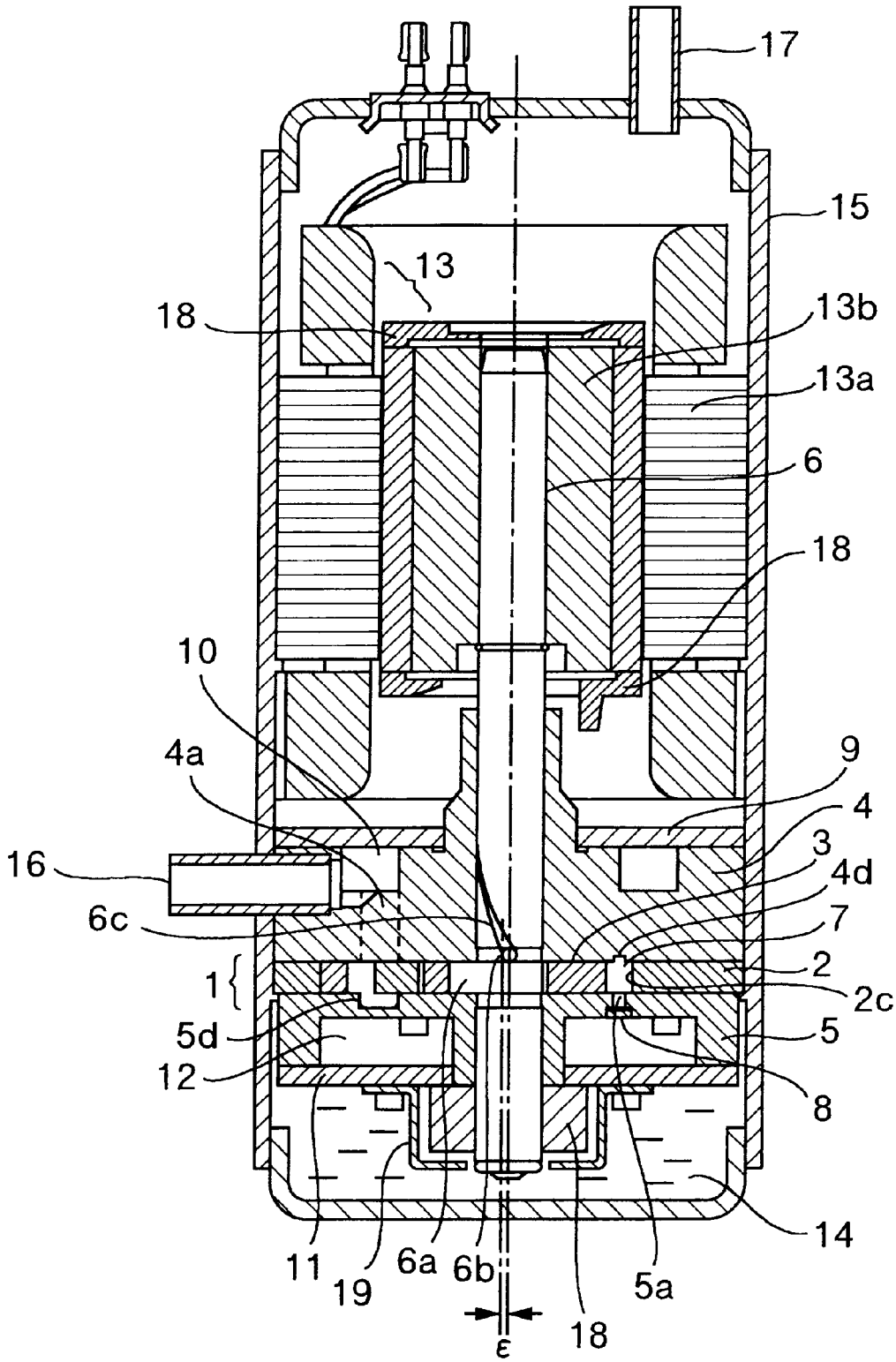
FIG. 3 is a longitudinally sectional view illustrating a displacement type compressor according to an embodiment of the present invention.
Figure 4:
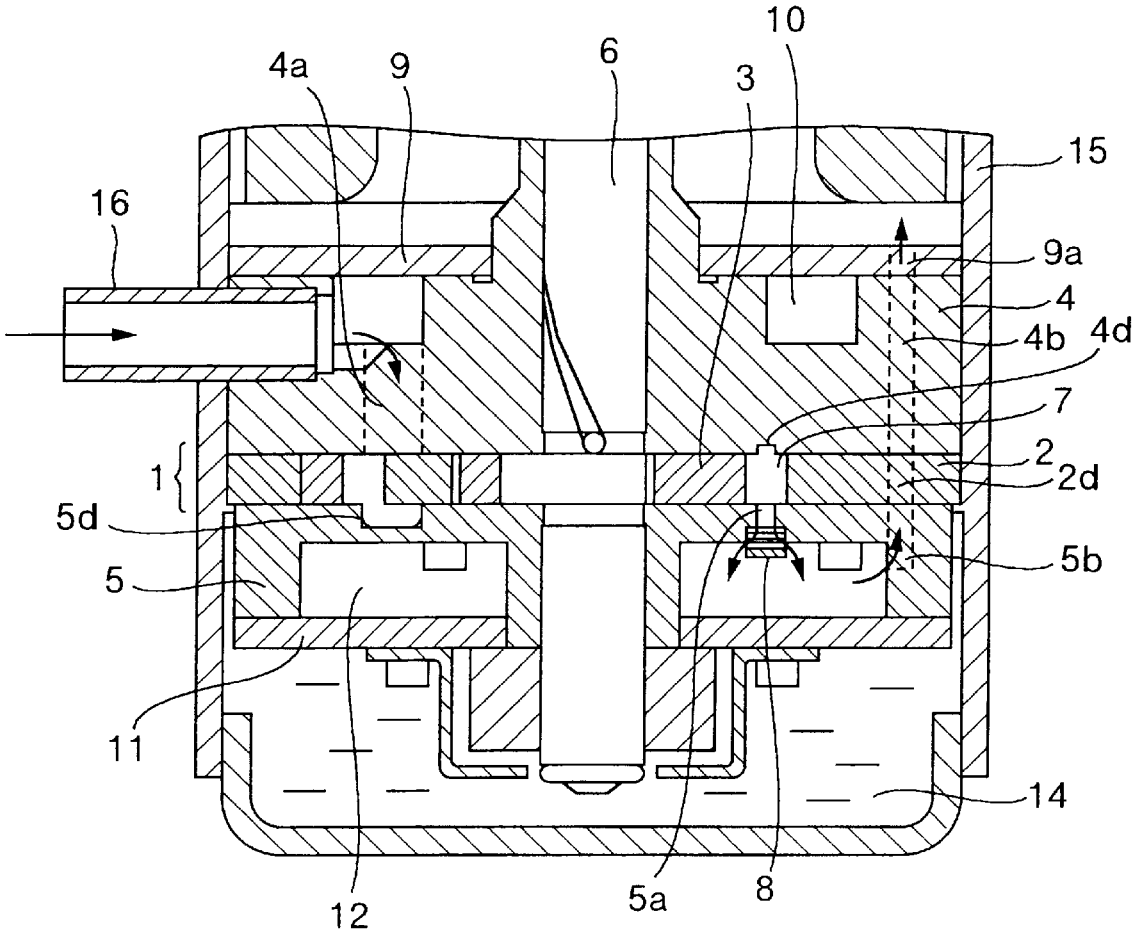
FIG. 4 is an enlarged sectional view illustrating the orbiting type compression element portion in the embodiment of the present invention.
Figure 5:
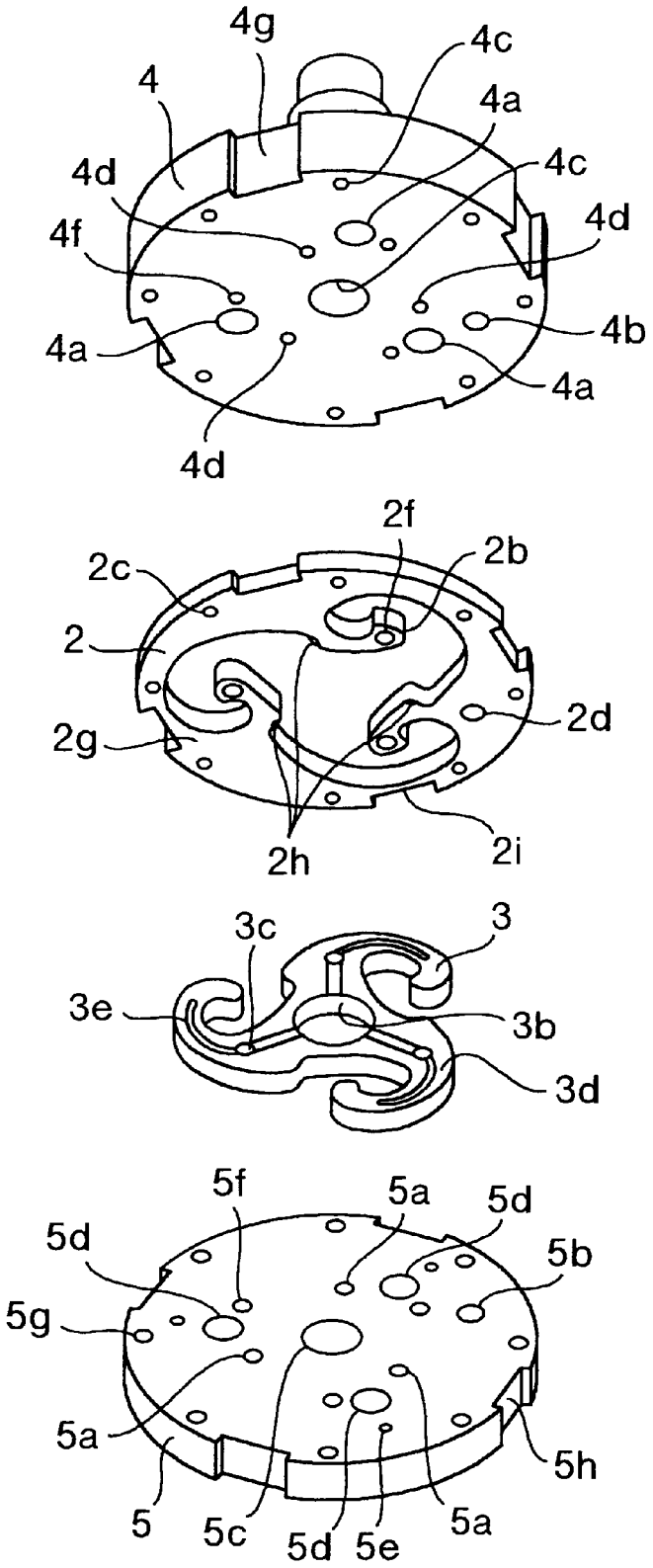
FIG. 5 is a perspective view illustrating an orbiting type compression element portion in the embodiment of the present invention.

DESCRIPTION OF THE PREFERRED EMBODIMENTS:

The above-mentioned features of the present invention will be more clearly understood from embodiments of the present invention. At first, explanation will be hereinbelow made of the structure of an orbiting fluid machine according to the present invention with reference to FIGS. 1 to 3. FIG. 1 is a plan view which shows a compression element according to the present invention, and FIGS. 2A to 2D are plan views which shows compressive operation of the compression element shown in FIG. 1, and FIG. 3 is a vertical sectional view a closed compressor incorporating the compression element shown in FIG. 1, FIG. 4 is an enlarged view illustrating the compression element shown in FIG. 2, and FIG. 5 is a perspective view which shows a compression element portion.

Referring to FIG. 1, a compression element 1 has triple laps having one and the same contour and combined together. An inner peripheral shape of a cylinder 2 is formed such that counterclockwise spiral hollow portions 2*a* having the same shape are disposed every 120 degrees angular intervals (having a center O'). A plurality (three in this case) vanes 2*b* projecting inward are provided on end portions of these respective counterclockwise spiral hollow portions 2. An orbiting piston 3 is arranged inside the cylinder 2 to engage with inner peripheral walls 2*c* (which are portons having a larger radius of curvature than that of vanes 2*b*) of the cylinder 2 and with the vanes 2*b*. Incidentally, a gap having a constant width (orbit radius) is defined between the cylinder 2 and the orbiting piston 3 when a center o' of the cylinder 2 is made to correspond to a center o of the orbiting piston 3.

Further, characters a, b, c, d, e, f denote contact points where the inner peripheral walls 2*c* of the cylinder 2, the vanes 2*b*, and the orbiting piston 3 contact with each other when engaging with one another. Here, the contour of the inner peripheral walls 2*c* of the cylinder 2 is composed of identical groups of curves which are smoothly and continuously connected at three positions. When attention is made to one of these position, curves which circumscribe the inner peripheral walls 2*c* and the vanes 2*b* can be regarded as a thick spiral curve (tip ends of the vanes 2*b* are considered as a starting end of the spiral curve), that is, it is composed of an outer wall curve (g–h) of the vane 2*b* which is a spiral curve having a wrap angle of about 360 degrees (it is meant that a design value of the wrap angle is 360 degrees, but this value cannot be precisely obtained due to manufacturing tolerance. The same as follows) and an inner wall curve (h–i) which is a spiral curve having a wrap angle of about 360 degrees. An contour of the inner peripheral walls 2*c* at the above-mentioned one position is defined by the outer wall curve and the inner wall curve. The spiral elements each composed of these three curves are cirumferentially arranged at substantially equal pitches (120 degrees), and the outer wall curve and the inner wall curve of the adjacent spiral elements are connected together by a smooth curve (for example, i–j) such as an arc to constitute a contour of an inner periphery of the cylinder. A contour of the outer peripheral walls 3*a* of the orbiting piston 3 is obtained by the same principle as that of the above-mentioned cylinder 2.

Although it has been described that the spiral elements each composed of three curves are circumferentially arranged at substantially equal pitches (120 degrees), which accounts for uniform distribution of a load caused by compressive operation to be described later, and easiness of manufacture. Unequal pitches serve if the above considerations are not problematic.

Now, explanation will be made of the compressive operation of the cylinder 2 and the orbiting piston 3 constructed as mentioned above. Suction ports 4*a* and discharge ports 5*a* are arranged at three positions, respectively. When a drive shaft 6 is rotated, the orbiting piston 3 revolves around a center o' of the stationary cylinder 2 with a turning radius of $\epsilon$ (which is a distance between the centers o, o') while not turning on its axis, so as to define around the center o of the orbiting piston 3 a plurality of working chambers 7 (those of a plurality of closed spaces defined between the inner periphery (inner wall) contour of the cylinder 2 and the outer periphery (side wall) contour of the orbiting piston 3, in which compression (discharge) stroke is effected after completion of suction stroke. At the completion of compression stroke, these spaces disappear and at the same time the suction stroke is completed, and so these spaces are counted as one. However, in the case of being used as a pump, those spaces are communicated with the outside through the discharge ports 5*a*). In the embodiment, three working chambers are always defined. That is, the same number of the working chambers as that of the vanes are defined. In the case where the number of the vanes (the number of spirals) is, for example, 4 (four), four working chambers are defined when the configuration is determined in the above manner mentioned above. That is, one working chamber is defined every spiral, so that pressures caused by compression are directed to the center portion, and accordingly, there can be offered such an advantage that less nonuniform contact is caused. The relationship between the number of spirals and the number of working chambers will be explained later.

Referring to FIG. 2, explanation will be made with respect to one working chamber 7, as surrounded by the contact points c, d, and shown by hatching, (the working chamber are divided into two chambers at the time of completion of suction stroke but are coupled into one chamber as soon as the compression stroke is initiated). FIG. 2A shows a condition in which suction of a working fluid into the working chamber 7 through the suction port 4*a* is completed. FIG. 2B shows a condition in which the drive shaft 6 is clockwise rotated by an angle of 90 degrees from the aforementioned condition. Further, FIG. 2C shows a condition in which rotation is continued by an angle of 180 degrees from the original position, and FIG. 2D shows a condition in which rotation is continued by an angle of 270 degrees from the original position. When the rotation is continued by an angle of 90 degrees from the condition shown in FIG. 2D, the condition is returned to one shown in FIG. 2A. Thus, the working chamber 7 decreases in volume as the rotation progresses, and accordingly, the working fluid is compressed with the discharge port 5*a* closed by a discharge valve 8 (as shown in FIG. 3). Further, when the pressure in the working chamber 7 is higher the outside discharge pressure, the discharge valve 8 is automatically opened by a pressure differential, and accordingly, the compressed working fluid is discharged through the discharge port 5*a*. The shaft rotating angle from the completion of suction (initiation of compression) to the completion of discharge is 360 degrees, and the next suction stroke is prepared while the compression stroke and the discharge stroke are carried out, so that at the time of the completion of discharge stroke the next compression stroke is initiated.

As mentioned above, the working chambers 7, in which continuous compression is effected, are distributed at substantially equal pitches around the drive shaft 6 located at the center of the orbiting piston 3, and compression with different phases is effected in the working chambers 7. That is, with one of the working chambers 7, the shaft rotating angle from suction to discharge is 360 degrees. However, in this embodiment, three working chambers 7 are defined and permit discharge of the working fluid with phases which are different from one other by an angle of 120 degrees, so that when it serves as a compressor, the working fluid is discharged three times over the shaft rotating angle of 360 degrees. Thus, it is possible to advantageously reduce pulsation in discharge, which is not found in a reciprocating type, a rotary type or a scroll type. Now, assuming that the spaces defined at the instance of completion of compression (the spaces surrounded by the contact points c, d) are a single space, the spaces carrying out suction stroke and the spaces carrying out compression stroke are designed to be made alternate obtained even in any compressor operating condition, and accordingly, the operation is shifted to the next compression stoke just at the completion of previous compression stroke, thereby enabling smoothly and continuously compressing the working fluid.

Next, explanation will be made of a compressor which incorporates the orbiting type compression element 1 with reference to FIGS. 3 to 5. Referring to FIG. 3, the orbiting type compression element 1 includes, in addition to the cylinder 2 and the orbiting piston 3 as detailed above, a drive shaft 6 having an eccentric portion 6*a* fitted in a bearing portion 3*b* in the center portion of the orbiting piston 3 and for driving the orbiting piston 3, a main bearing 4 and a sub-bearing 5 serving as bearing portions for journalling the end plates closing opposite end openings of the cylinder 2 and the drive shaft 6, a suction port 4*a* formed in the main bearing 4, a discharge port 5*a* formed in the sub-bearing 5, and a discharge valve 8 of a reed valve type (operated by a differential pressure) for opening and closing the discharge port 5*a*. The above-mentioned orbiting piston 3 engages with the inner peripheral wall 2*c* of the cylinder 2 while being made eccentric by a turning radius $\epsilon$ by the eccentric portion 6*a* of the drive shaft 6. Further, there are provided a suction cover 9 mounted to an end surface of the main bearing 4 to define a suction chamber 10, and a discharge cover 11 mounted to an end surface of the sub-bearing 5 to define discharge chambers 12.

A motor element 13 is composed of a stator 13*a*, which is shrinkage-fitted or so forth onto one end portion of the drive shaft 6, and a rotor 13*b*. This motor element 13 is composed of a brushless motor for enhancement of motor efficiency, and is driven and controlled by a three-phase inverter. However, a motor other than a brushless motor, such as a d.c. motor or a induction motor, may be used.

The lower end portion of the drive shaft 6 is submerged in a lubricating oil 14 stored in the bottom portion of a closed container 15. Further, there are provided a suction pipe 16 and a discharge pipe 17. The above-mentioned working chamber 7 is defined by the inner peripheral wall 2*c* of the cylinder 2, the vanes 2*b* and the orbiting piston 3 which engage with one another. Further, the discharge chamber 12 is isolated from pressure in the closed container 15 by a seal member such as an O-ring (which is not shown).

Further, since a high discharge pressure acts upon the lubricating oil 14 stored in the bottom portion of the closed container 15, the lubricating oil 14 is led into an oil feed hole (not shown) formed in the drive shaft 6 from the lower end of the latter which is submerged in the lubricating oil 14, under the action of a centrifugal pump, and is then fed into sliding portions such as the main bearing 4, the sub-bearing 5 and the working chamber 7 through an oil feed hole 6*b* and a oil feed groove 6*c* formed in the drive shaft 6 so as to enhance the lubrication of the sliding portions and the sealing quality between the working chambers 7.

The front and rear end portions of the rotor 13*b* in the motor element 13 and the lower end portion of the drive shaft 6 are provided with balancers 18, respectively, in order to cancel out amounts of unbalance during rotation. Further, an oil cover 19 is provided on the lower end of the a discharge cover 11 in order to reduce the agitating resistance of the lubricating oil caused by the rotation of the balancer 18 mounted to the lower end portion of the drive shaft 16. With this arrangement, a vertical type closed compressor is constituted.

Explanation will be made of flow of the working fluid (coolant) with reference to FIG. 4. As shown by arrows in the figure, the working fluid sucked into the closed container 15 through the suction pipe 16 flows into the suction chamber 10 in the suction cover 9 mounted to the end surface of the main bearing 4, and then flows into the compression element 1 through the suction port 4*a* where it is compressed as the working chamber 7 is decreases in volume in the orbiting motion of the orbiting piston 3 caused by rotation of the drive shaft 6. The compressed working fluid flows through the discharge port 5*a* formed in the sub-bearing 5 and into the discharge chamber 12 while pushing up the discharge valve 8. Then, the working fluid is led into the space on a side of the motor element 2 through discharge ports 5*b,* 2*d,* 4*b,* 9*a* formed respectively in the sub-bearing 5, the cylinder 2, the main bearing 4 and the suction cover 9 and communicated with the discharge chamber 12 to cool the motor element 2 and then discharged outside of the compressor through a discharge pipe (not shown).

Referring to FIG. 5 which is a perspective view illustrating the orbiting type compression element shown in FIG. 4, the main bearing 4 is formed in its center portion with a main bearing portion 4*c* journalling the drive shaft, and three suction ports 4*a* circumferentially arranged at equal pitches about the center of the main bearing portion 4*c*. Further, three pressure equalizing holes 4*d* in the form of a counter-sunk hole having a diameter substantially equal to that of the discharge ports 5*a* are formed at positions opposing to the discharge ports 5*a* formed in the sub-bearing 5, at circumferentially equal pitches about the center of the main bearing portion 4*c*. The cylinder 2 and the sub-bearing 5 are fastened by screws threaded in thread holes 4*e,* and the vane portions 2*b* of the cylinder 2 are secured by screws threaded in thread holes 4*f*. Further, the main bearing 4 is formed therein with cut-out portions 4*g* for returning oil. The sub-bearing 5 is formed therein with a discharge port 4*b* communicated with the discharge chamber 12.

The cylinder 2 mounted to the main bearing 4 is formed therein with holes 2*e* for attachment to the main bearing 4, and with holes 2*f* for securing to the main bearing in order to prevent radial deformation of the vane portions 2*b*. An end surface of the cylinder 2, which abuts against the discharge port 5*a* formed in the sub-bearing 5, is formed therein with an inclined flow passage 2*h*. Further, a cut-out portions 2*i* for returning of the oil is formed in the outer peripheral portion, and a discharge port 2*d* also formed in the cylinder 2 is communicated with the discharge chamber 12 formed in the sub-bearing 5.

The orbiting piston 3 is inserted in the cylinder 2. A bearing portion 3*b,* into which the eccentric portion 6*a* of the drive shaft 6 is inserted, and a pressure communication hole 3*c* are formed in the center portion of the orbiting piston 3. Oil grooves 3*e* are formed in the upper and lower end surfaces of the orbiting piston 3 respectively along the three vanes 3*d* extending from the bearing portion 3*b*.

The sub-bearing 5 is formed in its center portion with a sub-bearing portion 5*c* journalling the drive shaft 6, and with three discharge ports 5*a* circumferentially arranged at equal pitches about the center of the sub-bearing portion 5*c*. Pressure equalizing ports 5*d* in the form of a counter-sunk hole having a diameter substantially equal to that of the suction ports 4*a* formed in the main bearing 4 are formed at circumferentially equal pitches about the center of the sub-bearing portion 5*c* at circumferentially equal pitches to be positioned opposing the suction ports 4*a*. The discharge valve 8 is secured by screws threaded into thread holes 5*e,* and the vane 2*b* parts of the cylinder 2 are mounted to the main bearing 4 by screws threaded into holes 5*f* while the sub-bearing 5 and the cylinder 2 are secured to the main bearing 4 by screws threaded into holes 5*g*. Cut-out portions 5*h* for returning of the oil are formed in the outer peripheral portion of the sub-bearing 5. A discharge port 5*b* is communicated with the discharge chamber 12 formed in the sub-bearing 5.

With the above-mentioned arrangement, the pressure equalizing holes 4*d,* 5*d* formed in the main bearing 4 and the sub-bearing 5 uniformize pressures acting upon the upper and lower end surfaces of the orbiting piston 3 located in a space defined by the end surface of the main bearing 4, the end surface of the sub-bearing 5 and the cylinder 2 during suction stroke and discharge, and the stable behavior of the orbiting piston 3 during operation of the compressor can be obtained. Next, this function will be explained.

A suction and compression (discharge) space is defined by members (in this embodiment, the main bearing 4 and the sub-bearing 5, each of which serves as both a bearing and an end plate) which interpose therebetween the cylinder 2 and the orbiting pistons, the inner wall of the cylinder 2 and the outer wall of the orbiting piston 3. The orbiting piston 3 orbits within the space defined by the wall of the cylinder 2 and the members interposing thereof. As for the sliding motion, sliding between the both end portions of the orbiting piston 3 and that portion of the main bearing 4, which serves as an end plate (a surface of the main bearing 4 opposing the orbiting piston 3 in FIG. 5), and that portion of the sub-bearing 5, which serves as an end plate (a surface of the sub-bearing 5 opposing the orbiting piston 3 in FIG. 5) is substantial.

If such sliding is excessive, metals rub together to excessively wear due to abrasion, and as a result, a suction space and a compression space (discharge space) adjacent to each other are connected together at the worn portion to raise a problem of increased internal leakage, and a problem of reduction in the overall adiabatic efficiency due to increased mechanical loss caused by rubbing between the metals.

The above-mentioned problems are solved by the provision of oil supply means for supplying an oil to surfaces of the orbiting piston 3 opposing the end plates. That is, in this embodiment, the provision of the oil grooves 3*e* for supplying a lubricating oil fed from the shaft to the both end surfaces of the orbiting piston 3 enables the orbiting piston 3 to orbit without making contact with the both end plates to enhance a sealing quality between the adjacent spaces.

By the way, test results have shown that only the provision of the oil grooves 3*e* causes contact between the orbiting piston 3 and the end surfaces of the main bearing 4 and the sub-bearing 5 which interpose therebetween the orbiting piston 3. This fact will be explained with reference to FIG. 4. Since the working fluid is discharged against the outside pressure from the working chamber through the discharge ports 5*a,* a force for pressing the orbiting piston 3 against a surface opposite to the discharge ports 5*a* acts at the discharge ports 5*a* from the outside through the discharge ports 5*a*. Thus, the orbiting piston 3 is pressed against the end surface of the main bearing 4 in this case, causing nonuniform contact.

Further, flow of the working fluid flowing through from the outside exerts a force at the suction ports 4*a,* which presses the orbiting piston 3 against the end surface of the sub-bearing 5 in this case. Accordingly, the orbiting piston 3 is pressed against the sub-bearing 5, causing nonuniform contact.

In order to solve the above-mentioned problems, in this embodiment, the pressure equalizing holes 4*d* in the form of a counter-sunk hole having a diameter substantially equal to that of the discharge ports 5*a* formed in the sub-bearing 5 are formed to be positioned opposing the discharge ports 5*a*. Accordingly, the force pressing the orbiting piston 5 through the discharge port 5*a* also serves as a force pressing the orbiting piston 3 from the pressure equalizing holes 4*d* through the intermediary of the working fluid as a force transmitting medium which flows into the pressure equalizing holes 4*d*. Accordingly, the both forces cancel each other, so that the orbiting piston 3 can orbit without making contact with either of the end plates. The same is the case with the pressure equalizing holes 5*d* formed at positions opposing the suction ports 4*a*. The diameters of the pressure equalizing holes 4*d*, 5*d* are set to be equal to those of the discharge ports 5*a* and the suction ports 4*a*, but the depth of the pressure equalizing holes 5*d* (opposing the discharge ports 4*a*) is set to be greater than that of the pressure equalizing holes 4*d* (opposing the suction ports 5*a*) in order to balance the pressing force with the force for canceling out the former.

As a result, since the orbiting piston 3 can maintain an equal axial gap between it and the end surfaces of the main bearing 4 and the sub-bearing 5, which interpose therebetween the orbiting piston 3, with oil films therebetween, friction and abrasion due to nonuniform contact and the like are eliminated and the orbiting piston can orbit with the lubricating oil between it and the end plates, thus enabling providing a displacement type compressor having a higher reliability as compared with the one having a single oil supply means. Further, the radial gap in the sliding portions between the orbiting piston 3 and the cylinder 2 can be held to be uniform, so that it is possible to provide the displacement type compressor having a high performance. The results of tests have shown that the overall adiabatic efficiency can be enhanced by 6% as compared with a compressor without both pressure equalizing holes.

Further, the pressure equalizing holes 4*d*, 5*d* are arranged to ensure the suction and discharge passages, and accordingly, fluid loss during suction stroke and discharge stroke can be reduced to afford enhancement in the efficiency of the displacement compressor. As mentioned above, the action and effects given by the oil supply grooves and the pressure equalizing holes can be similarly obtained in embodiments which will be explained below. In this embodiment, the pressure equalizing holes are provided for both discharge ports 5*a* and the suction ports 4*a*, but even though they are provided only for either the discharge ports 5*a* or the suction ports 4*a*, substantial effects can be also obtained.

Further, inclined flow passages 2*h* are provided on the vanes 2*b* of the cylinder 2 in the vicinity of the discharge ports 5*a*, and so the pressure loss and the fluid loss can be greatly reduced during discharge stroke, thus enabling enhancing the performance of the displacement type compressor. Further, the discharge stroke of the compression element 1 in this embodiment is longer than that of a conventional rolling piston type compression element, so that the flow rate of the working fluid during discharge stroke can be lowered to reduce the fluid loss (excessive compression loss), thus enabling providing a displacement type compressor having a high performance.

Although explanation has been made of a compressor in which the pressure equalizing holes 4*d*, 5*d* are formed in the main bearing 4 and the sub-bearing 5, respectively, in the above-mentioned embodiment, similar effects as mentioned above can be obtained even if pressure equalizing holes are provided to be positioned opposing respectively the ports of the sub-bearing in the case where both suction and discharge ports are formed in one and the same component, for example, the main bearing. Further, since the pressure equalizing holes may be formed in the orbiting piston 3 and the cylinder 2 in terms of dimensional requirements.

Next, detailed explanation will be made of relationships between a wrap angle θ and a shaft rotating angle θc, as mentioned above. The shaft rotating angle θc can be changed by changing the wrap angle θ. For example, when the shaft rotating angle from the completion of suction to the completion of discharge is made small by making the wrap angle smaller than 360 degrees, the discharge ports and the suction ports would be communicated with each other to cause a problem of counterflow of once sucked fluid, due to expansion of the fluid in the discharge port. Further, when the shaft rotating angle is made large by making the shaft rotating angle from the completion of suction to the completion of discharge greater than 360 degrees, two working chambers having different sizes are defined during a period from the completion of suction to the time of communication with a space having a discharge port, and accordingly, in the case of being used as a compressor, an increase in pressure of these two working chambers are different from each other, so that irreversible mixing loss is caused when the both chambers merge with each other, resulting in not only an increase in compression power and reduction in the rigidity of the orbiting piston. Further, if it is used as a liquid pump, it does not work as a pump since a working chamber not communicated with the discharge port is formed. Accordingly, it is desirable that the wrap angle θ is 360 degrees within an allowable range of accuracy.

Japanese Patent Unexamined Publication No. 55-23353 (Document 1) discloses a fluid machine in which the shaft rotating angle θc during compression stroke is θc=180 degrees while Japanese Patent Unexamined Publication No. H5-202869 (Document 2) and Japanese Patent Unexamined Publication No. H6-280758 (Document 3) disclose a fluid machine in which the shaft rotating angle θc during compression stroke is θc=210 degrees. The period from the completion of discharge of the working fluid to the initiation of next compression (completion of suction) corresponds to a shaft rotating angle of 108 degrees in the case of Document 1 and to a shaft rotating angle of 150 degrees in the case of the document 2 or 3.

Figure 16A:
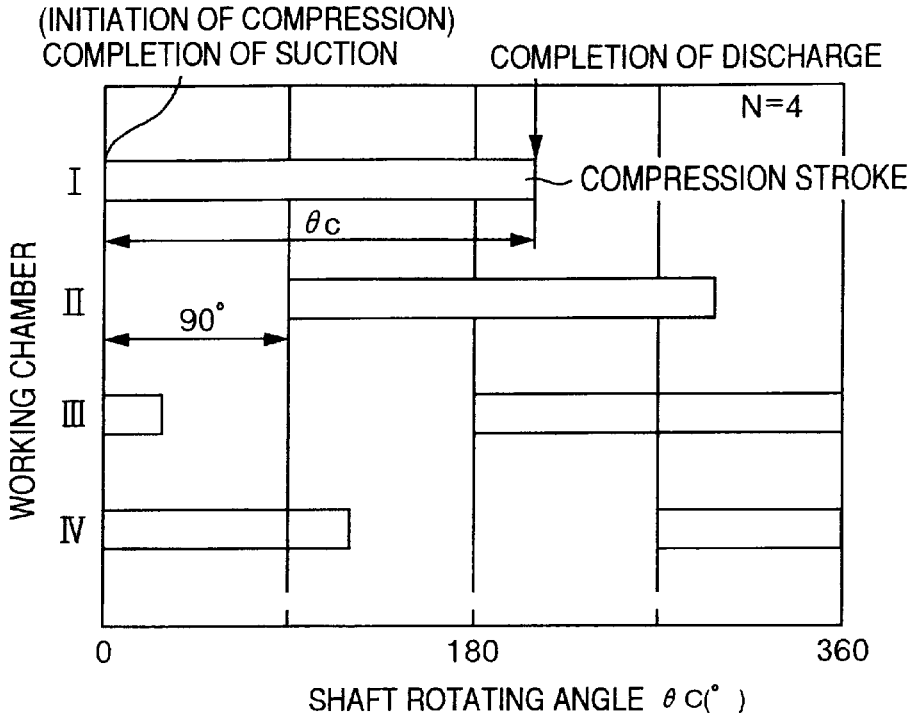
FIGS. 16A to 16B are views showing relationships between a shaft rotating angle and a working chamber in quadruple laps.

FIG. 16 shows a diagram of compression stroke of the working chambers (which are denoted by the reference numerals I, II, III, IV) during one revolution of the shaft in the case where the shaft rotating angle θc during compression stroke is 210 degrees where the number N of laps is 4 and four working chambers are formed with the shaft rotating angle θc being 360 degrees. The number n of the working chambers simultaneously formed at a certain angle is n=2 or 3. The maximum number of working chambers simultaneously formed is 3 which is smaller than the number of laps.

Figure 17A:
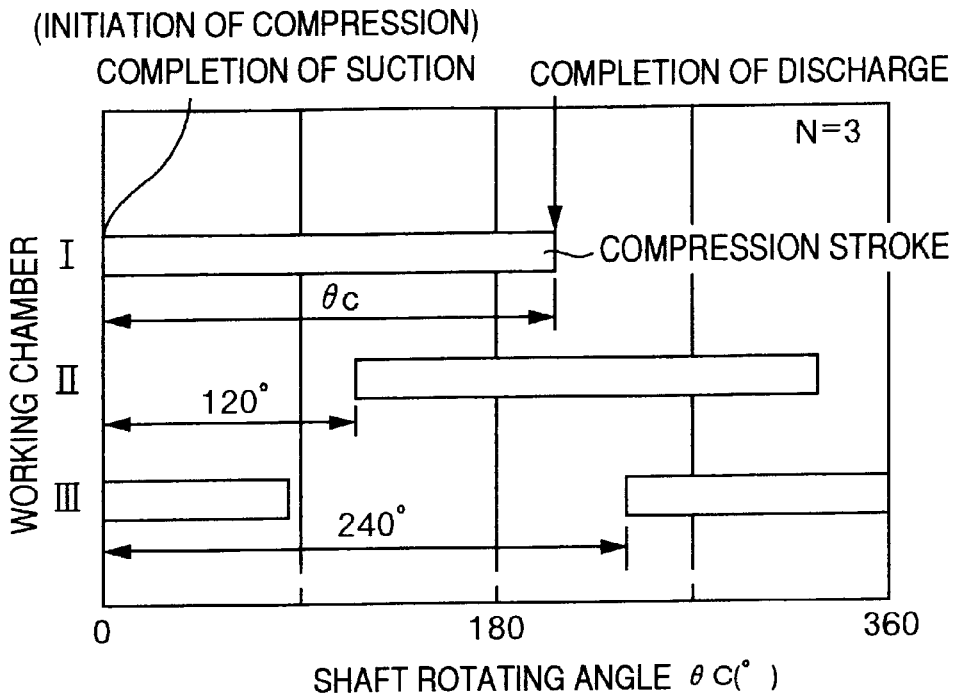
FIGS. 17A to 17B are view showing relationships between a shaft rotating angle and a working chamber in triple laps.
Figure 17B:
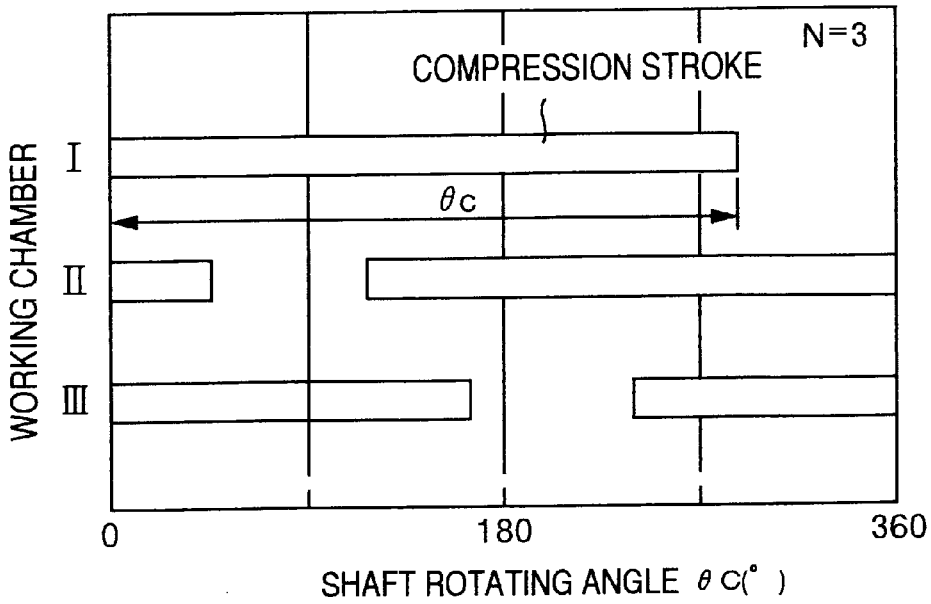

Similarly, FIG. 17 shows a diagram of compression stroke of the working chambers in the case where the number N of laps is N=3 and the shaft rotating angle θc during compression stroke is θc=210 degrees. In this case, the number n of the working chambers simultaneously formed is three which is n=1 or 2 and the maximum number of the working chambers simultaneously formed is 2 which is smaller than the number of laps.

In such a condition, the working chambers are formed offset around the drive shaft, so that a dynamic unbalance is caused to make a self-rotating moment exerted to the orbiting piston excessive, resulting in an inceased contact load between the orbiting piston and the cylinder to raise a problem of an increase in the mechanical friction loss and a problem of degradation in performance due to increased mechanical friction loss, and a problem of a decreased reliability due to performance due to abrasion of the vanes.

In order to solve the above-mentioned problems, in this embodiment, the external peripheral contour of the orbiting piston and the inner peripheral contour of the cylinder are formed in such a way that the shaft rotating angle θc during compression stroke satisfies the following formula:

$$(((N-1)/N)*360 \text{ degrees})<\theta c<360 \text{ degrees} \quad \text{(Exp. 1).}$$

Figure 16B:
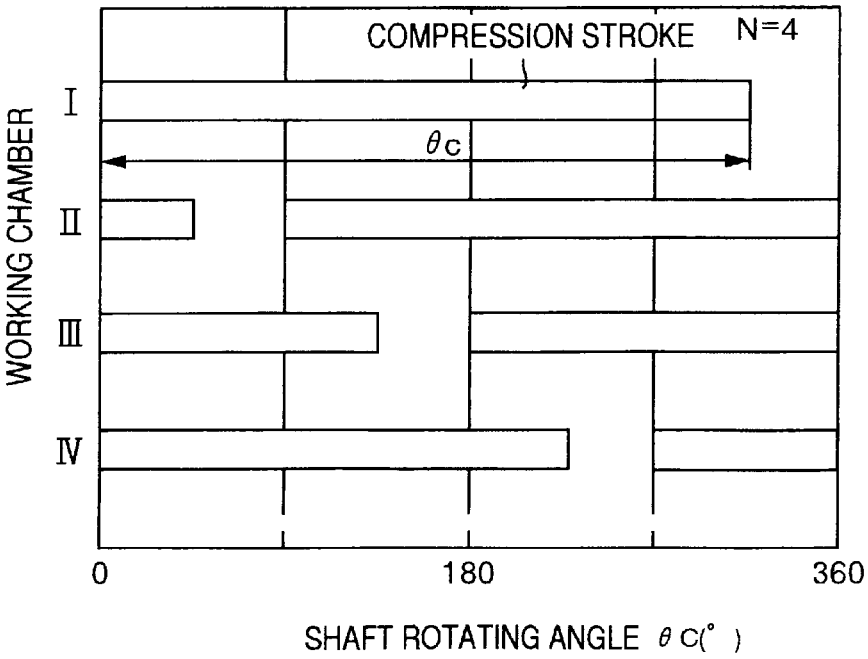

In other words, the wrap angle θ during compression stroke falls within the range given by the formula 1. Referring to FIG. 16B, the shaft rotating angle θc during compression stroke is larger than 270 degrees, and the number n of the working chambers formed simultaneously is n=3 or 4, that is, the maximum number of the working chambers is 4. This value coincides with the number N of laps, that is N=4. Further, referring to FIG. 17B, the shaft rotating angle θc during compression is greater than 240 degrees, and the number n of the working chambers formed simultaneously is n=2 or 3, that is, the maximum number of working chambers is 3. This value corresponding to the number N of laps, that is, N=3.

Thus, making the lower limit value of the shaft rotating angle θc during compression stroke greater than the value of the right hand side of the formula 1 results in that the maximum number of working chambers simultaneously formed is greater than the number N spiral, the working chambers are uniformly distributed about the drive shaft to improve the dynamic balance, thus the self-rotating moment exerted to the orbiting piston is reduced, and further, the contact load between the orbiting piston and the cylinder is also reduced, thereby enabling improving the performance due to reduction in mechanical friction loss and reliability of the contact portion.

Meanwhile, in view of the expression 1, the upper limit of the shaft rotating angle θc during compression stroke is 360 degrees on the basis of the formula (1). The upper limit of the shaft rotating angle θc during compression stroke is ideally 360 degrees. As mentioned above, a time lag between the completion of discharge of the working fluid and the initiation of next compression stroke (completion of suction) can be set to 0. Thus, it is possible to eliminate reduction in suction efficiency caused by the re-expansion of gas in the gap volume which occurs in the case of θc<360 degrees as well as occurrence of irreversible mixing loss caused due to different pressure rises in the two working chambers in the case of θc<360 degrees when the two working chambers merges together. The later phenomenon will be explained with reference to FIG. 18.

Figure 18A:
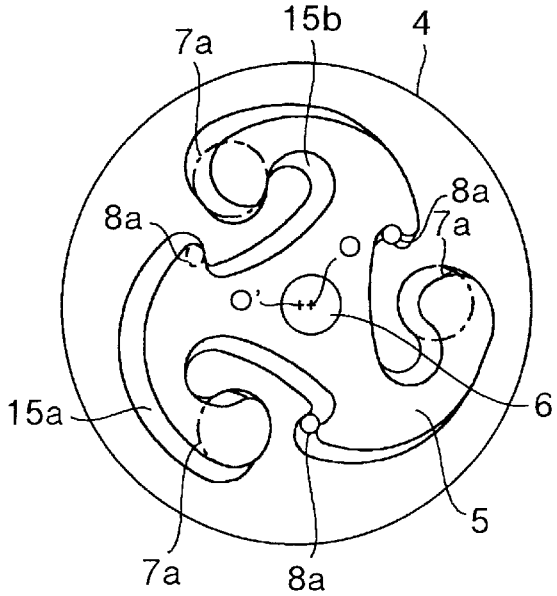
FIGS. 18A to 18C are views illustrating an operation in the case where a wrap angle of the compression element is greater than 360 degrees.
Figure 18B:
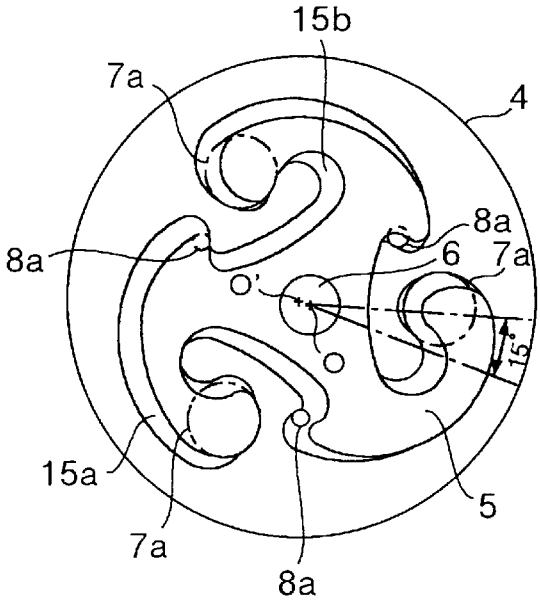
Figure 18C:
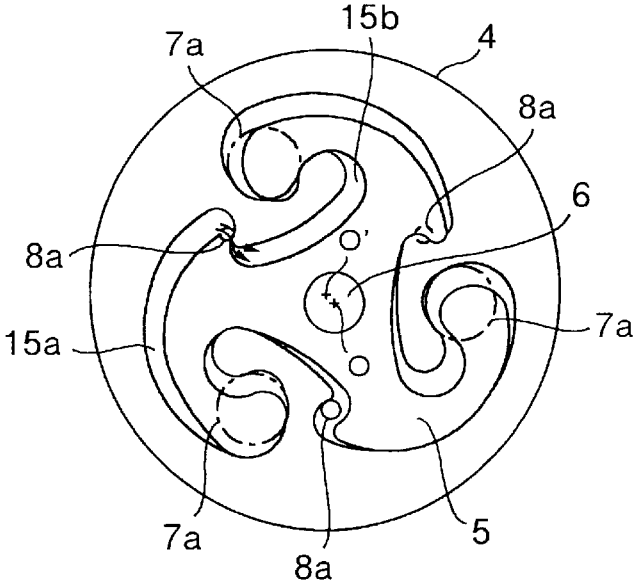

The shaft rotating angle θc during compression stroke of the displacement fluid machine shown in FIG. 18 is 375 degrees. FIG. 18A shows a state, in which suction is completed in the two working chambers 15*a,* 15*b* cross-hatched in the figure. At this time, the pressures of two working chambers 15*a,* 15*b* are equal to each other to be a suction pressure Ps. The discharge port 8*a* is located between the working chambers 15*a,* 15*b,* and so the both working chambers 15*a,* 15*b* are not communicated with each other. FIG. 18B shows a state, in which the shaft rotation advances by a shaft rotating angle of 15 degrees from the state, and so the discharge port 8*a* and the two working chambers 15*a,* 15*b* are positioned just before they are communicated with one another. At this time, the volume of the working chamber 15*a* is smaller than that at the time of completion of suction shown in FIG. 18A, that is, compression advances with the pressure in the working chamber 15*a* higher than the suction pressure Ps. In contrast, the volume of the working chamber 15*b* is larger than that at the time of completion of suction, that is, the pressure therein is lower than the suction pressure Ps due to expansion. When the working chambers 15*a,* 15*b* merge (communicate) with each other at the next instance, irreversible mixing occurs as indicated by arrows in FIG. 18C, and the performance is lowered due to an increase in compression power. Accordingly, it can be concluded that the upper limit of the shaft rotating angle θc during compression stroke is ideally 360 degrees.

Further, the shaft rotating angle of the compression element 1 in this embodiment is 360 degrees from the completion of suction (initiation of compression) to the completion of discharge, and accordingly, a next suction stroke is set up while the compression stroke and the discharge stroke are carried out so that the completion of the discharge just initiates the next compression. That is, since the working chambers 7 undergoing compression are distributed at equal pitches around the center o of the orbiting piston 3, the respective working chambers 7 continuously undergo suction stroke and compression stroke getting out of phase from one another, and so torque pulsation of the drive shaft 6 becomes small per revolution to attain decreased vibrations and noises of the displacement type compressor.

As mentioned above, in the compression element 1 of this embodiment, the working chambers 7 having a shat rotating angle of 360 degrees from the completion of suction to the completion of compression are distributed at equal pitches around the eccentric portion 6*a* of the drive shaft 6 inserted in the bearing portion 3*b* of the orbiting piston 3, so that the point of action of the self-rotating moment can be made close to the vicinity of the orbiting piston 3 to be advantageous in that the self-rotating moment acting upon the orbiting piston 3 can be extremely decreased in configuration. Further, in the compression element 1 of this embodiment, the shape of engaging arcuate portions of the orbiting piston 3 and the cylinder in the vicinity of the discharge port 5*a* formed in the sub-bearing 5 are formed to have a large curvature, so that a sealing quality during discharge can be ensured to provide a displacement type compressor having a high efficiency. Further, in the compression element 1 of this embodiment, a sliding area at which the orbiting piston 3 and the cylinder 2 slide, and on which the self-rotating moment 1 acts, is arranged in the vicinity of the suction port 4*a* for the working fluid having a high temperature and a high oil viscosity, so that the self-rotating moment 1 acting upon the orbiting piston 3 can be reduced and the mechanical friction loss in the sliding area can be reduced, thereby enabling providing a displacement type compressor having a high efficiency.

Further, the compression element 1 in this embodiment can complete the compression stroke in a short time, and so the leakage of the working fluid can be reduced to improve the performance of a displacement type compressor. Further, the compression element 1 in this embodiment dispenses with a spiral shape and end plates in a scroll type compressor, which enables achieving enhanced productivity and reduced cost. Further, any end plates are dispensed with to eliminate action of thrust load as caused in the scroll type compressor, which achieves enhanced performance of the displacement type compressor. Further, the compression element 1 of this embodiment can be made thin in wall thickness, which magnifies freedom in manufacturing processes such as a punching process. Further, the shape of the compression element facilitates management of axial accuracy to enable improving the productivity. At least one of the outer peripheral wall 3*a* of the orbiting piston 3 and the inner peripheral wall 2*c* of the cylinder 2 is subjected to a coating treatment with a high sliding characteristic enables gap control on the sliding area between both the orbiting piston and the cylinder during initial operation of the displacement type compressor to prevent degradation in the performance of the displacement type compressor at the initial stage of the operation. Further, with the arrangement of the invention, the absence of any reciprocating slide mechanism such as an Oldham's ring as used in a scroll type compressor for preventing self-rotation of an orbiting scroll provides complete balancing of the rotary shaft system to enable reducing vibrations and noises from the compressor. Further, the invention can contribute to reducing the size and the weight of the compressor.

Further, the arrangement disclosed in the above-mentioned Japanese Patent Unexamined Publication No. S55-23353 is problematic in that when a single space (suction space), which two adjacent spaces are connected together to define, forms working chambers from the connected state, flow of the working fluid is induced within the suction space following the orbiting motion of a piston, and the working fluid moves from the space, which is to form the working chambers, toward a suction space, which adjacent spaces successively formed are connected to define, so that a volume of the working fluid confined in the working chambers becomes less than the maximum volume of the working chambers to cause reduction in suction efficiency. If the suction efficiency is reduced, the capacities of the compressor and the pump will be reduced. In contrast, such problem is not involved in this embodiment, in which a closed space (the working chamber 7) is formed just at the time when the suction volume becomes substantially maximum.

Further, the displacement type compressor in this embodiment utilizes a high pressure system in which a discharge pressure atmosphere is produced in the closed chamber 15, and so the lubricating oil 14 is acted by a high pressure (discharge pressure) to permit the above-mentioned centrifugal pumping action to readily supply the lubricating oil 14 to the respective sliding portions in the compressor, thereby enabling improving a lubricating quality between the working chambers 7 and in the sliding portions.

As mentioned above, although explanation is given to this embodiment, in which the number of spiral bodies constituting the shape of the outer peripheral surface of the orbiting piston 3 and the shape of the inner peripheral surface of the cylinder 2 is three, the pressure equalizing holes 4*d*, 4*d* and the inclined flow passages 2*h* may be arranged in accordance with a shape of the compression element 1 having any practical number (2 to 10) of spiral bodies. The following advantages can be obtained if the number of the spiral bodies defining the shape of the outer peripheral surface of the orbiting piston 3 and the shape of the inner peripheral surface of the cylinder 2 is gradually increased within a practical range.

(1) Torque variation can be decreased to reduce vibrations and noises;

(2) On condition that the cylinders 2 have the same outer diameter, the cylinders 2 can be reduced in height for ensuring the same suction volume, which can make the compression element 1 small in size and weight.

(3) As the self-rotating moment exerted on the orbiting piston 3 decreases, the mechanical friction loss in the sliding portions of the orbiting piston 3 and the cylinder 2 can be reduced, thereby improving the reliability.

(4) The pressure pulsation in the suction and discharge pipes can be reduced to attain further reduction in vibrations and noises. Thereby, it is possible to realize a fluid machine (compressors or pumps) with no pulsation, which is demaded for medical and industrial use.

Further, although explanation has been given to the method of combining a plurality of arcs as a method of constituting the contours of the orbiting piston 3 and the cylinder 2, the present invention should not be limited to the method, and a similar contour can be formed by combination of arbitrary (high-order) curves.

Figure 6:
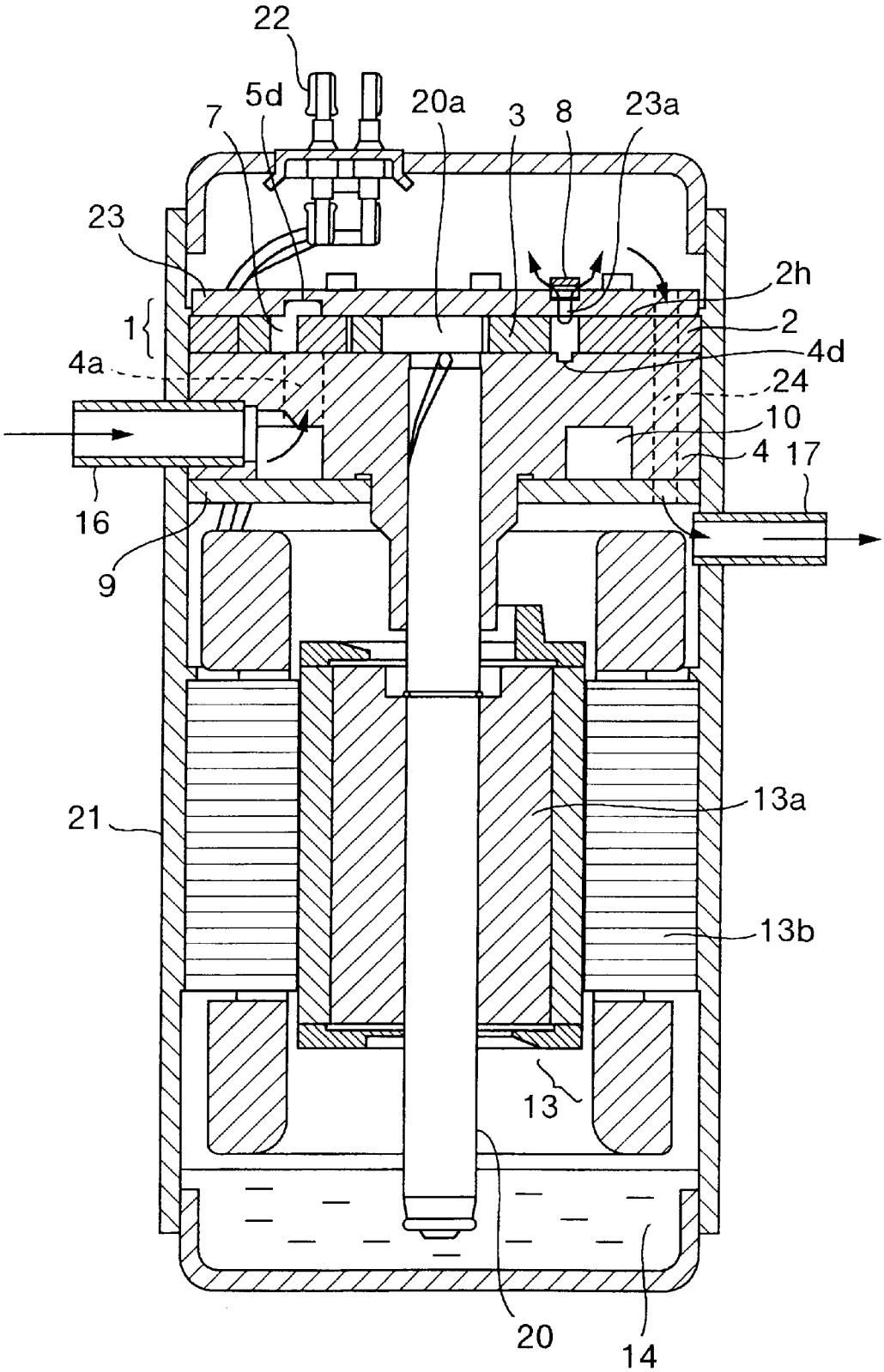
FIG. 6 is a longitudinal sectional view illustrating a displacement type compressor.

FIG. 6 is a vertical sectional view showing a displacement type compressor according to another embodiment of the present invention. In this embodiment, the configuration of the orbiting type compression element differs from that shown in FIG. 1, and different points will be detailed herebelow. Referring to FIG. 6, the same reference numerals as those in FIGS. 3 to 5 are used to denote the same components which act in the same manner as in those in FIGS. 3 to 5.

In FIG. 6, a compression element 1 according to the present invention is arranged on the upper end of the motor element 13 for driving the compression element 1. The orbiting piston 3 being the compression element 1 engages with vanes 2*b* of a cylinder 2, and is formed in its center portion with a bearing portion 3*b* fitted with an eccentric portion 20*a* of a drive shaft 20. The drive shaft 20 is rotatably journalled by a main bearing portion 4*c* formed in a main bearing 4 to support the orbiting piston 3 inserted into the eccentric portion 20*a* of the drive shaft 20 in cantilever-like manner, and the drive shaft 20 has its lower end portion submerged in the lubricating oil 14 stored in the bottom portion of a closed container 21. The closed container 21 is provided at its outer peripheral portion with a suction pipe 16, a discharge pipe 17 and a current introducing terminal 22. The operation principle of this orbiting compression element 1 is similar to that of the compression element shown in FIG. 3 and explanation therefor is omitted.

As indicated by arrows in the figure, the working fluid flowing into the closed container 21 through the suction pipe 16 flows into the compression element 1 by way of a suction chamber 10 defined by a suction cover 9 mounted to an end surface of the main bearing 4 and a suction port 4*a*. When the drive shaft 20 is rotated by the motor elemetn 13, the orbiting piston 3 orbits so that the volume of a working chamber 7 decreases for operation of compression. The compressed working fluid pushes up a discharge valve 8 through the intermediary of a discharge port 23*a* formed in a discharge cover 21, and is conducted into the upper space of the closed container 21 to enter into a space in the motor element 13 through a discharge port 24 to be discharged outside of the closed container 21 through the discharge pipe 17.

Figure 7:
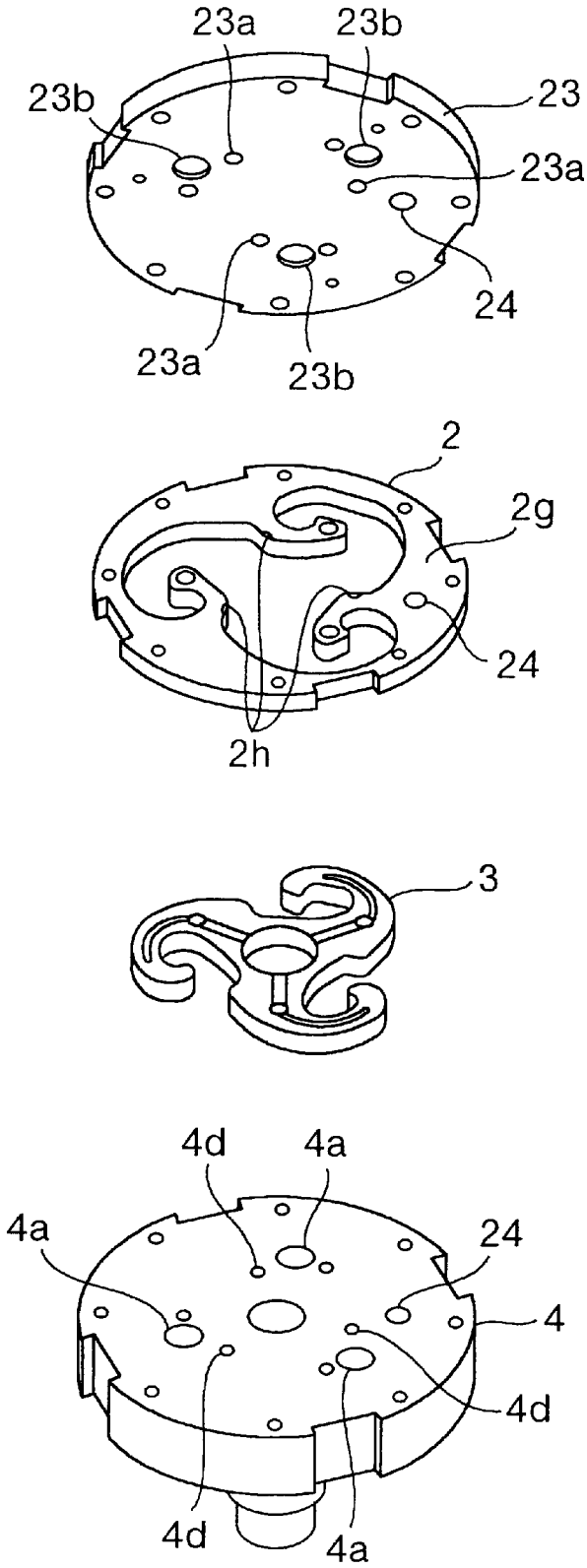
FIG. 7 is a perspective view illustrating an orbiting type compression element according to an embodiment of the present invention.

FIG. 7 is a perspective view illustrating the orbiting type compression element portion shown in FIG. 6. Three pressure equalizing holes 4*d* in the form of a counter-sunk hole having a diameter substantially equal to that of the discharge ports 23*a* formed in the discharge cover 23 are formed in the main bearing 4 to be positioned opposing the discharge ports 23*a* and at circumferentially equal pitches around the center of the main bearing 4. Further, inclined flow passages 2*h* are formed in the end surface 2*g* of the cylinder 2 which abuts against the discharge ports 23*a* formed in the discharge cover 23. Further, pressure equalizing holes 23*b* in the form of a counter-sunk hole having a diameter substantially equal to that of the suction ports 4*a* formed in the main bearing 4 are formed to be positioned opposing the suction ports 4*a* and at cicumfrentially equal pitches around the center of the discharge cover 23.

With the above-mentioned arrangement, effects equivalent to those having been explained with reference to FIG. 4 are obtained. Further, the drive shaft 2 supported in cantilever-like manner dispenses with components such as the sub-bearing 5 shown in FIG. 4, so that it is possible to achieve reduced cost and enhanced productivity due to a decease in the number of components for a displacement type compressor.

Figure 8:
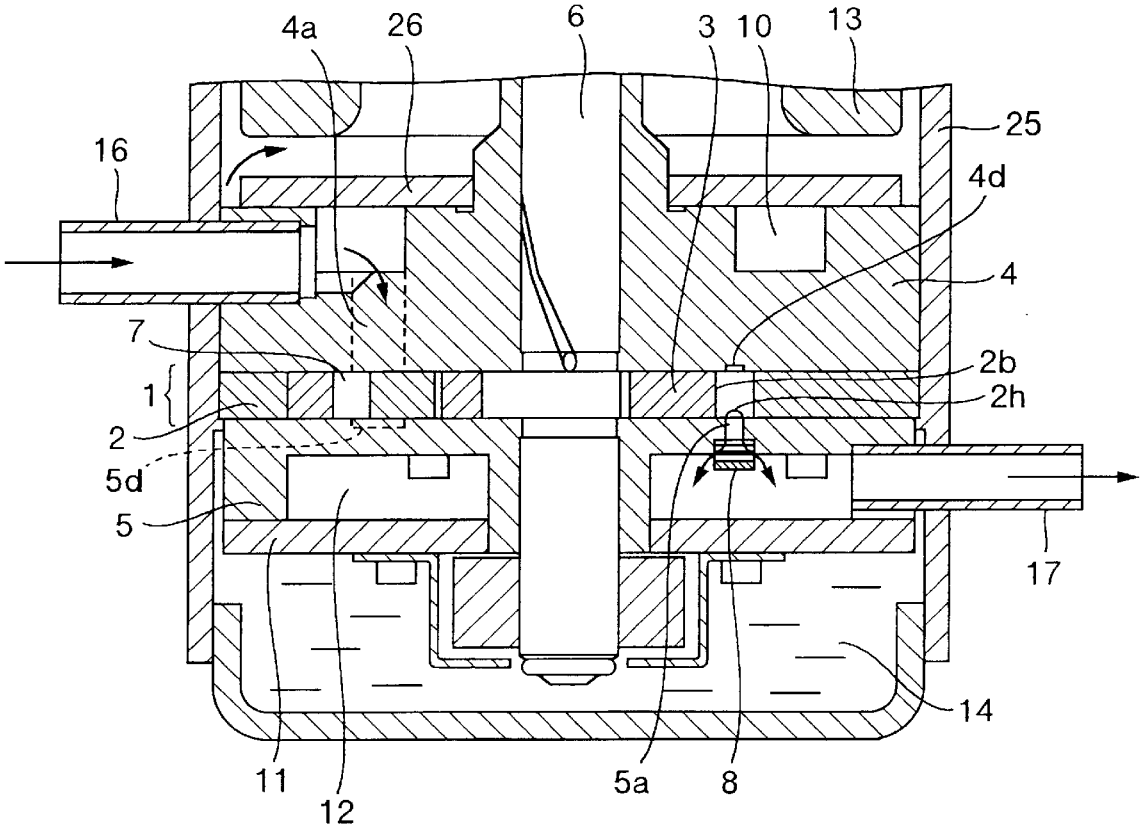
FIG. 8 is an enlarged view illustrating an orbiting type compression element of a displacement type compressor according to an embodiment of the present invention.

FIG. 8 is a vertical sectional view illustrating a low-pressure type compression element portion according to another embodiment of the present invention. The compression element in this embodiment differs from that shown in FIG. 4 in that the closed container is of a low pressure type. Such point will be hereinbelow detailed.

The reference numeral 1 denotes a compression element 1 according to the present invention, and 25 a closed container 25 in which the compression element 1 and a motor element 14 are received. A suction cover 26 is arranged on an end surface of a main bearing 4 to define a suction chamber 10 communicated with a space in the closed container 2, in which the motor element 13 is located. In like manner shown in FIG. 4, pressure equalizing holes 5*d* in the form of a counter-sunk hole and having a diameter substantially equal to the suction ports 4*a* formed in the main bearing 4 are formed to be positioned opposing the suction ports 4*a* on one end surface of a sub-bearing 5, and pressure equalizing holes 4*d* in the form of a counter-sunk hole and having a diameter substantially equal to that of discharge ports 5*a* formed in the sub-bearing 5 are formed to be positioned opposing the discharge ports 5*a* and on an end surface of the main bearing 4. Further, inclined flow passages 2*h* are formed in arcuate portions of the vanes 2*b* of the cylinder 2 in the vicinity of the discharge ports 5*a*. With this arrangement, as indicated by arrows in the figure, the working fluid having flown into the closed container 25 through the suction pipe 16 flows into the compression element 1 through the suction chamber 10 defined by the suction cover 26 mounted to the main bearing 4 and the suction port 4*a*, and when the drive shaft 6 is rotated by the motor element 13, the swive piston 3 orbits to decrease the volume of the working chamber 7 for operation of compression. The compressed working fluid pushes up a discharge valve 8 through the inermediary of the discharge port 5*a* formed in the sub-bearing 5 to flow into the discharge chamber 12 to be discharged outside of the compressor through the discharge pipe 17.

As a result, action of the pressure equalizing holes 4*d*, 5*d* makes the pressures at the upper and lower end surfaces of the orbiting piston 3 uniform, so that the orbiting piston 3 behaves stably during rotation thereof to provide a highly reliable displacement type compressor. Further, a radial gap in a sliding area between the orbiting piston 3 and the cylinder 2, which influences upon the performance of the compressor, can be maintained constant to provide a displacement compressor having a high performance. Further, the inclined flow passages 2*h* formed in the cylinder 2 are effective in greatly reducing pressure loss and fluid loss during discharge stroke, thereby enabling improving the performance of a displacement type compressor.

Further, the suction chamber 10 and the closed container 25 are communicated with each other, so that a suction pressure (low pressure) is produced in the closed container 25. Thus, the closed container 25 is made low in pressure to offer the following advantages:

(1) Heating of the motor element 13 effected by compressed working fluid having a high temperature can be reduced to enhance the efficiency of a motor to improve the performance of a displacement type compressor;

(2) Owing to low pressure, the working fluid compatible with the lubricating oil 14 such as fleon is decreased in a rate dissolved in the lubricating oil 14, so that a bubbling phenomenon of the lubricating oil 14 in the bearing portion or the like can be suppressed to enhance the reliability;

(3) The closed container 25 can be decreased in proof pressure to achieve reducing the wall thickness and the weights of components in the compressor.

Incidentally, the compression element 1 of a low pressure type according to the invention can be also applied to a compression element 1 having a practical number (2 to 10) of spiral bodies constituting the shape of the outer peripheral surface of the orbiting piston 3 and the shape of the inner peripheral surface of the cylinder 2, and a cantilever support type displacement compressor. Further, the arrangement of the pressure equalizing holes 4*d*, 5*d* and the inclined flow passages 2*h* can be applied to the low pressure type displacement compressor in this embodiment.

As mentioned above, in the compressor in which the orbiting type fluid machine according to the present invention is used, either a high pressure type or a low pressure can be selected in accordance with specifications and use of equipments, a kind of a production facility or the like to greatly magnify the freedom in design.

Figure 9:
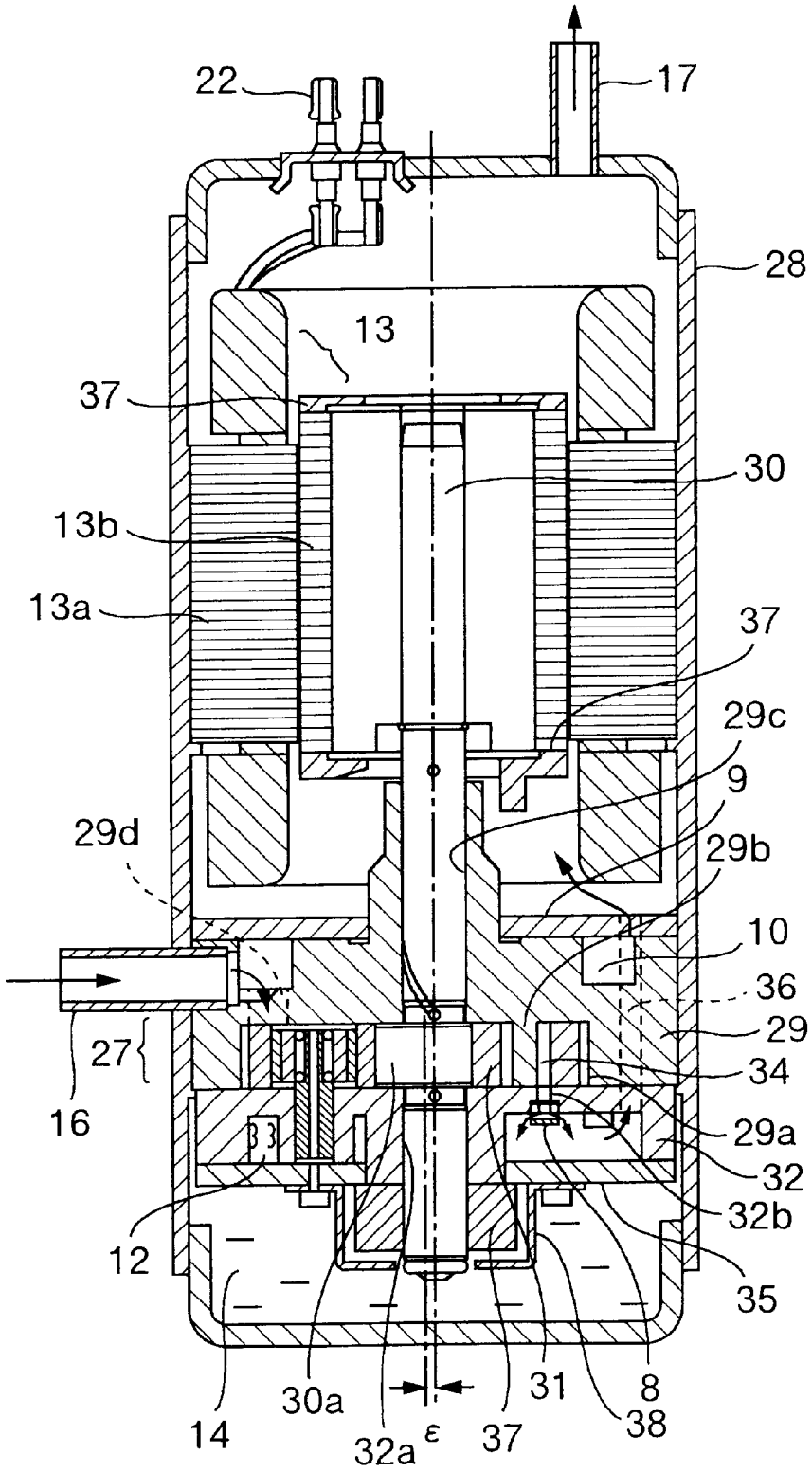
FIG. 9 is a longitudinal sectional view illustrating a displacement type compressor according to an embodiment of the present invention.

FIG. 9 is a vertical sectional view illustrating a displacement type compressor incorporating a self-rotation preventing mechanism. In the figure, the reference numeral 27 denotes a compression element according to the present invention; 13 a motor element for driving the compression element 27; and 28 a closed container 28 which received therein the compression element 27 and the motor element 13 and is provided with a suction pipe 16, a discharge pipe 17 and a current introduction terminal 22. The compression element 27 comprises a cylinder 29 having arcuate vanes 29*b* projecting inward from the inner peripheral wall 29*a* of the cylinder 29 and serving as a main bearing portion 29*c* for journalling a drive shaft 30, an orbiting piston 31 adapted to engage with the vanes 29*b* of the cylinder 29 and provided in its center portion with a bearing hole portion 31, into which an eccentric portion 30*a* of the drive shaft 50 being eccentric by an orbit radius $\epsilon$ is fitted, a sub-bearing member 32 abutting against end surfaces of the cylinder 29 and the orbiting piston 30 engaged, and provided with a sub-bearing portion 32 journalling the drive shaft 30, a suction port 29 formed in the cylinder 29, a discharge port 32*b* formed in the sub-bearing member 32, a reed valve type discharge valve 8 for opening and closing the discharge port 22*b*. Further, the orbiting piston 31 and the sub-bearing member 32 are provided with a pin type self-rotation preventing member 32. Incidentally, the vanes 29*b* of the cylinder 29 and the orbiting piston 31 define working chambers 34.

Further, the reference numeral 9 denotes a suction cover mounted to an end surface of the cylinder 29, and 35 a discharge cover mounted to an end surface of the sub-bearing member 32. The suction cover 9 and the discharge cover 35 are shut from a space on the lubricating oil 14 side and a space on the motor element 13 side in the closed container 28, respectively, to define a suction chamber 10 and a discharge chamber 12, respectively. The lower end portion of the drive shaft 30 is submerged in a lubricating oil 14 stored in the bottom portion of the closed container 28. The discharge chamber 12 in the sub-bearing member 32 is communicated with the space on the motor element 13 side through a communication passage 36. Further, the motor element 13 is composed of a stator 13*a* and a rotor 13*b* which is fixed to an end portion of the drive shaft 30 by means of shrinkage-fitting or the like. Further, balancers 37 are provided on front and rear ends of the rotor 13*b*, and on a lower end of the drive shaft 30 to completely cancel an amount of unbalance during rotation. Further, an oil cover 38 is mounted to a lower end of the discharge cover 35 to reduce the agitating resistance of the lubricating oil caused by the rotation of the balancer 37 mounted to the lower end of the drive shaft 30.

Figure 10:
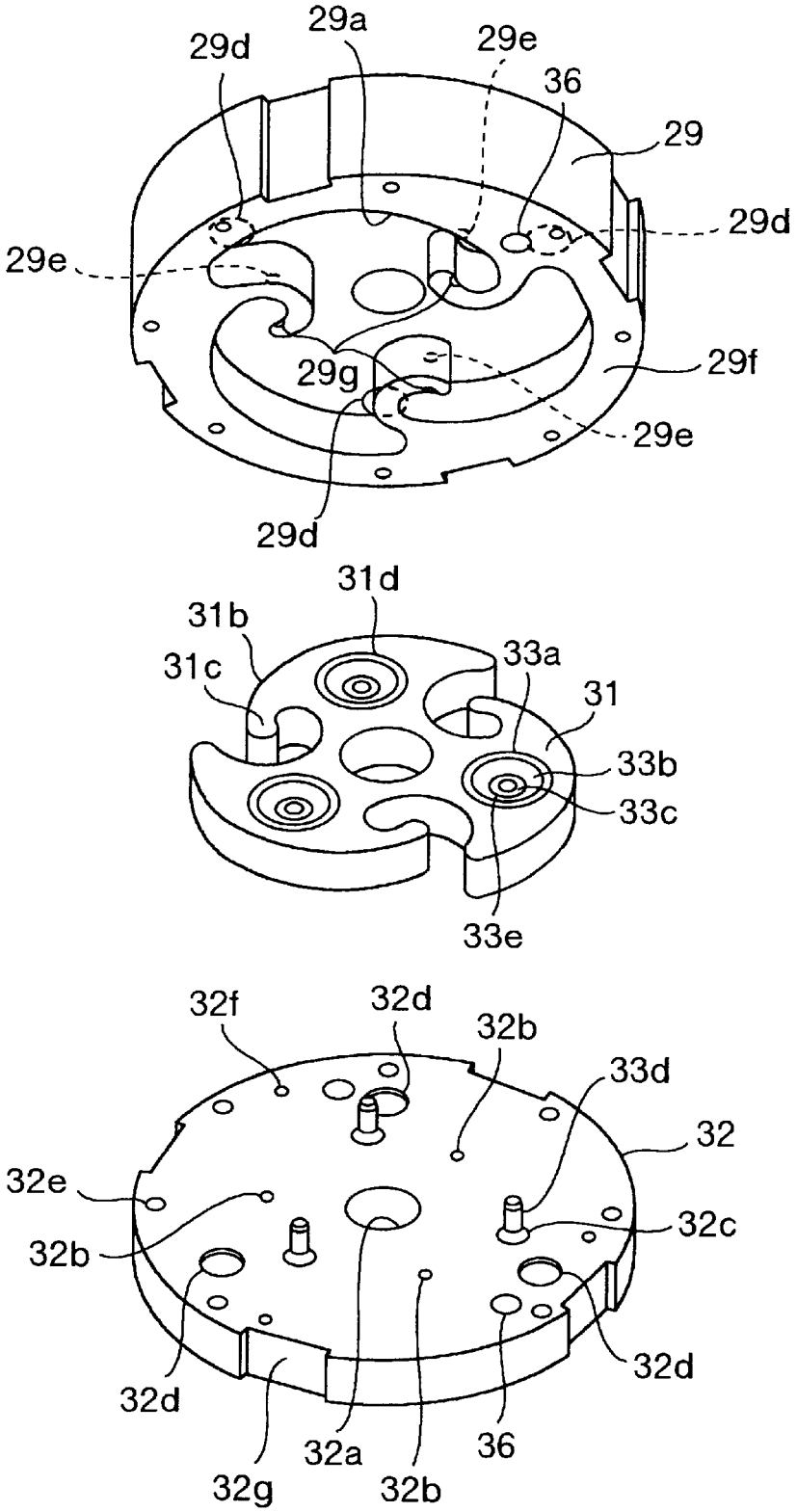
FIG. 10 is a perspective view illustrating an orbiting type compression element portion according to an embodiment of the present invention.

FIG. 10 is a perspective view illustrating the compression element portion 27 shown in FIG. 9. The outer peripheral surface of the orbiting piston 31 is shaped such that three spiral bodies constituted by multiple arcuate curves are combined to be smoothly continued at three locations. At one among the three locations, a curve defining the outer peripheral wall 31*b* and the vane 31*c* can be regarded as a thick spiral curve, and the outer wall curve thereof is a spiral curve having a substantial wrap angle of 360 degrees while the inner wall curve is a spiral curve having a substantial wrap angle of 180 degrees, and the outer wall curve and the inner wall curve are continuously connected to form a tangential curve. The inner peripheral wall 29*a* of the cylinder 29 is constituted by the same principle as that of the orbiting piston 31.

The pin type self-rotation preventing mechanism 33 comprises bearing members 33*a,* eccentric members 33*b,* bearing members 33*c* and pin members 33*d.* The bearing member 33*a* are fitted in and secured to holes 31*d* which are circumferentially formed at equal pitches around the center of the orbiting piston 31. Further, the eccentric members 33*b* are formed therein with eccentric holes 33*e.* A distance between the center of each eccentric member 33*b* and the center of the associated hole is set to be equal to an eccentricity $\epsilon$ (turning radius) of the eccentric portion 30*a* of the drive shaft 30, and the eccentric members 33*b* are slidably inserted in the holes in the bearing members 33*a.* Further, the bearing members 33*c* is fitted in and secured to the holes 33*e* of the eccentric members 33*b,* and the pin members 33*d* fixed to the sub-bearing member 32 are slidably inserted into holes formed in the center portions of the bearing members 33*c.* The pin members 33*d* are fixed in the holes 32*c* formed at equal pitches around the center of the sub-bearing member 32. The pin members 33*d* and the central holes of the bearing members 33*c* inserted in the eccentric holes of the eccentric members 33*b* are respectively coaxial with one another. With this arrangement, the pin type self-rotation preventing mechanism is constituted.

The sub-bearing member 32 is formed at its center with a sub-bearing portion 32*a* journalling the drive shaft 30, and with discharge ports 32*b* arranged at circumferentially equal pitches around the center of the sub-bearing portion 32*a.* Further, pressure equalizing hole 32*d* in the form of a counter-sunk hole and having a diameter substantially equal to that of the suction ports 29*d* formed in the cylinder 29 are formed in the sub-bearing member 32 to be positioned opposing the suction ports 29*d* and at circumferentially equal pitches around the center of the sub-bearing member 32. Further, the sub-bearing member 32 is secured to the cylinder 29 by means of screws inserted in holes 32*e,* and the discharge valve 8 is secured by screws inserted in thread holes 32*f.* Further, cut-outs 32*g* for returning of the oil are formed in the outer peripheral portion of the sub-bearing member 32. Further, there is formed a communication passage 36.

Three pressure equalizing holes 29*e* in the form of a counter-sunk hole and having a diameter substantially equal to that of the discharge ports 32*b* formed in the sub-bearing member 32 are formed in the cylinder 29 at circumferentially equal pitches around the center of the main bearing 29*c.* Further, inclined flow passages 29*g* are formed in the end surface 29*f* of the cylinder 29, which abuts against the discharge ports 32*b* formed in the sub-bearing member 32.

Next, explanation will be made of the flow of the working fluid. As shown by arrows in FIG. 9, the working fluid having flown into the closed chamber 28 through the suction pipe 18 is conducted into the compression element 27 through the suction chamber 10 defined by the suction ports 29*d* formed in the cylinder 29 and the suction cover 9, and when the drive shaft 30 is rotated by the motor element 13, the orbiting piston 31 orbits to decrease the volume of the working chamber 34 for operation of compression. The compressed working fluid pushes up the discharge valve 8 through the discharge ports 32*b* formed in the sub-bearing member 32 to be conducted into the discharge chamber 12 to be discharged outside of the compressor through the communication hole 36, the motor element 13 and the discharge pipe 17. At this time, a high discharge pressure acts upon the lubricating oil 14 stored in the bottom portion of the closed container 28, so that the lubricating oil 14 is conducted into an oil supply hole 30*b* (not shown) formed in the drive shaft 30 by a centrifugal pump action, and then is fed to sliding portions between the inner peripheral wall 29*a* of the cylinder 29, the outer peripheral wall 31*b* of the orbiting piston 31, and the like, through an oil supply hole 30*b* communicated with the above-mentioned communication hole in the drive shaft 30 and an oil supply groove 30*c.* Further, the lubricating oil 14 having been conducted into the working chamber 34 through the sliding portions is solved into the working fluid to flow from the discharge chamber 12 and through the communication passage 36 into the motor element 13 to cool the latter, thus forming a feed oil path, in which the lubricating oil 14 is separated from the working fluid and is then returned into the bottom portion of the closed container 28. Further, oil supply holes are formed in the pin members 33*d* in the self-rotation preventing mechanism 33, and are communicated with the lubricating oil 14 in the bottom portion of the closed container 38 through oil supply holes formed in the discharge cover 35 on a rear end side of the pin members 33*d.* Thus, the members constituting the pin type self-rotation preventing mechanism 33 are lubricated under centrifugal pump action.

Next, explanation will be made of an operation of the compression element 27 and the pin type self-rotation preventing mechanism 33 with reference to FIGS. 11A to 11D. The eccentric portion 30*a* of the drive shaft 30 is fitted in the bearing hole 31*a* of the orbiting piston 31, and thus the orbiting piston 31 and the cylinder 29 engage with each other while being shifted from each other by an orbit radius $\epsilon$. The outer peripheral surface of the orbiting piston 31 engages with the inner peripheral surface of the cylinder 29 at contact points a, b, d, d, e, f. The orbiting piston 31 is formed therein with three holes 31*d,* which are disposed on a circle at cicumferentially equal pitches around the center o. Further, the pin type self-rotation preventing mechanisms 33 are located respectively in the holes 31*d.* Further, a distance between each of centers o1 of the holes 31*d* of the orbiting piston 31, the bearing portions 33*a* and the eccentric members 33*b,* and an associated one of centers o1' of the holes of the eccentric members 33*b,* the bearing members 33*c* and the pin members 33*d* is made equal to an orbit radius $\epsilon$ which is equal to a distance between the center o of the orbiting piston 31 and the center o' of the cylinder 29.

Next, explanation will be made of operation of compression. When the drive shaft 30 is rotated, the orbiting piston 31 inserted in the eccentric portion 30*a* orbits around the center of the stationary cylinder 29 with the turning radius $\epsilon$, so that a plurality working chambers 34 are defined around the center of the orbiting piston.

Figures 11A, 11B, 11C, 11D:
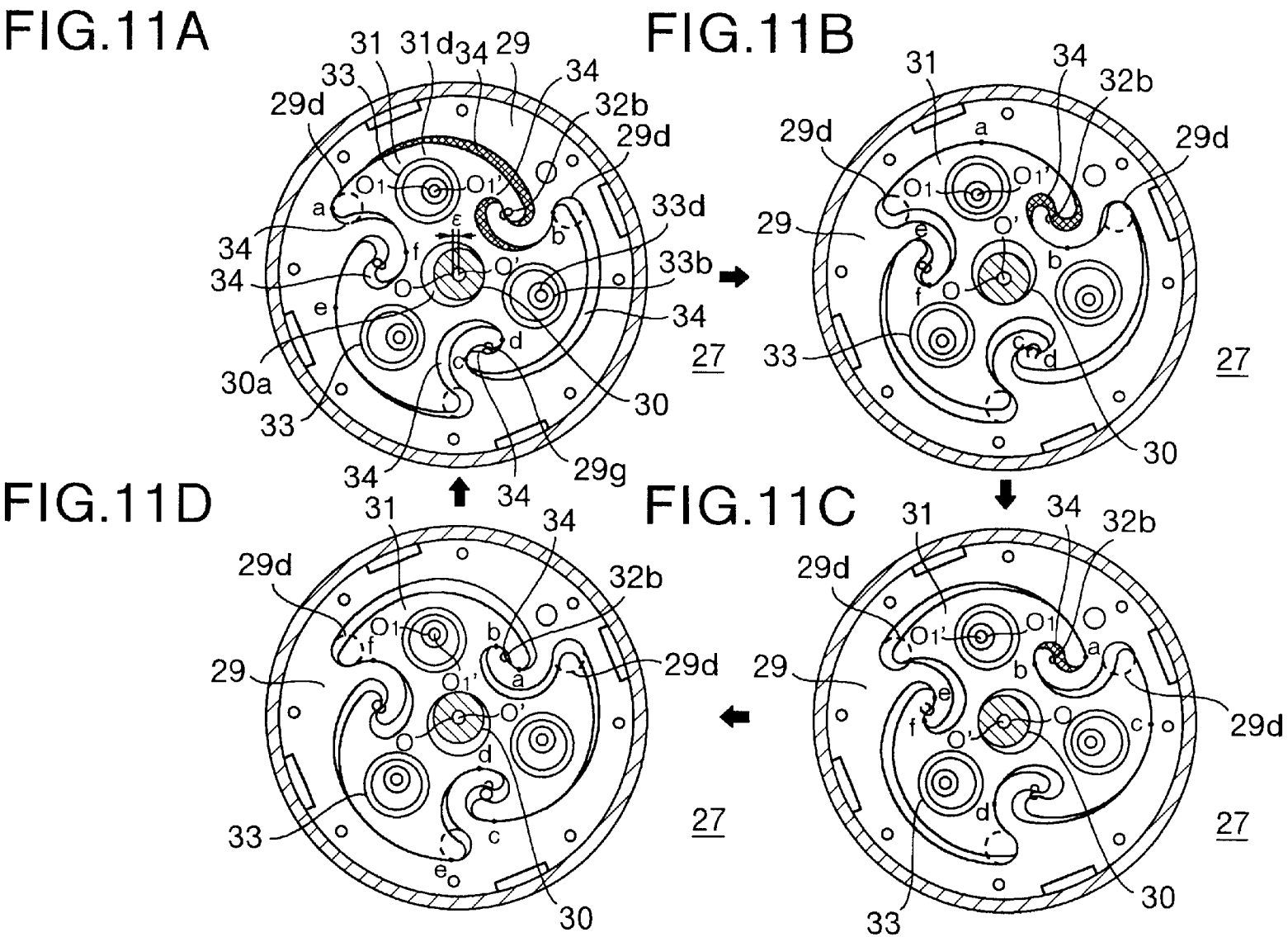
FIGS. 11A to 11D are plan views showing operational principles of an orbiting type compression element in an embodiment of the present invention.

One of the working chambers 34 (which is divided into two working chambers 34 with the discharge port 32 therebetween at the time of completion of suction, but the two working chambers are connected with each other just after the initiation of compression stroke to make a single working chamber) surrounded by the contact points a, b behaves in the following manner. FIG. 11A shows a state in which suction of the working fluid into this working chamber 34 through the suction port 29*d* is completed, FIG. 11B showing a state in which the drive shat 30 is closckwise rotated by an angle of 90 degrees from the state shown in FIG. 11A, FIG. 11C showing a state in which the drive shaft 30 is clockwise rotated by an angle of 90 degrees from the state shown in FIG. 11B, and FIG. 11D showing a state in which the drive shaft 30 is clockwise rotated by an angle of 90 degrees from the state shown in FIG. 11C. When the drive shaft 10 is clockwise rotated further by an angle of 90 degrees, the working chamber in discussion is returned to the initial state shown in FIG. 11A. Accordingly, the working chamber 34 decreases in volume as the drive shaft 30 is rotated while the discharge valve 8 is closed, so that the working fluid is compressed.

Further, when the pressure in the working chamber becomes higher than the discharge pressure outside the working chamber (that is, the pressure in the closed container), a pressure differential causes the discharge valve 8 to automatically open, and accordingly, the compressed working fluid is discharged through the discharge port 32*b*. The shaft rotating angle from the completion of suction (initiation of compression) to the completion of discharge is 360 degrees, such that the next suction stroke is prepared while the compression stroke and the discharge stroke are effected, and the time of completion of the present discharge is the time of initiation of the next suction. That is, the working chambers 23 undergoing compression are distributed at equal pitches around the center o of the orbiting piston 31, and successively undergo suction stroke and compression stroke while being shifted out of phase, so that torque pulsation per revolution of the drive shaft 30 becomes small to achieve reduction in vibrations and noises of the displacement type compressor.

Further, the pin members 32*d* having equal angular pitches around the center o' of the sub-bearing member 32 and secured and supported in the same direction as that of the turning radius $\epsilon$ are slidably inserted in the holes in the eccentric members 33*b* in the pin type self-rotation preventing mechanisms 33 provided on the orbiting piston 31. With this arrangement, the eccentric members 33*b* inserted in the three holes 31*d* of the orbiting piston 31 with the pin members 32*d* at its center perform orbiting motion similar to that of the orbiting piston 31, with a distance between the center of the orbiting piston 31 and the center o' of the cylinder 29 (that is, the turning radius $\epsilon$) while sliding in the holes of the bearing members 33*a,* as shown in FIGS. 11A to 11D.

As a result, the action of the pin type self-rotation preventing mechanism 33 permits the orbiting piston 31 to perform precise orbiting motion while the gaps at the contact points between the orbiting piston 31 and the cylinder 29 can be maintained constant to reduce friction and abrasion to provide a highly reliable displacement type compressor. Further, the pin type self-rotation preventing mechanisms 33 can be arranged inside the working chambers 24 defined between the orbiting piston 31 and the cylinder 29, so that it is possible to reduce the diameter of the compression element 27.

Further, the pressure equalizing holes 29*e* are formed in the bottom surface portion of the cylinder 29, against which the orbiting piston 31 abuts, to be positioned opposing the discharge ports 32*b* formed in the sub-bearing member 32, and the pressure equalizing holes 32*d* are formed in the end surface of the sub-bearing member 32, against which the orbiting piston 31 abuts, to be positioned opposing the suction ports 29*d* formed in the cylinder 29, so that the pressures at the upper and lower ends of the orbiting piston 31 becomes uniform during suction stroke and discharge stroke, thereby enabling making the orbiting piston 31 stably behaving during operation. As a result, the orbiting piston 31 can hold gaps of the same magnitude between it and the end surfaces of the cylinder 29 and the sub-bearing member 32, between which the orbiting piston 29 is interposed, while providing an oil film in the gaps. Thereby it is possible to provide a highly reliable displacement type compressor free from friction and abrasion caused by nonuniform contact or the like.

Further, the inclined flow passages 29*g* are formed in the arcuate portions of the vanes 29 of the cylinder 29 in the vicinity of the discharge ports 32*b,* whereby pressure loss and fluid loss during discharge stroke can be greatly reduced to achieve enhanced performance of the displacement type compressor.

Further, with the compression element 27 of this embodiment, the working chambers 34 having a shaft rotating angle of 360 degrees from the completion of suction to the completion of discharge are distributed at equal pitches around the eccentric portion 30*a* of the drive shaft 30 fitted into the orbiting piston 31, whereby the acting points of self-rotating moments can be made near the center of the orbiting piston 31 to offer such a feature that the self-rotating moments acting upon the orbiting piston 31 can be made small.

Further, in this embodiment, the cylinder 29 is constructed such that the cylinder 2 and the main bearing 4 shown in FIG. 3 are made integral with each other, thereby reducing the number of components and improving the productivity.

Further, the displacement type compressor in this embodiment is of a high pressure type in which a discharge pressure is produced in the closed container 28. In this type, a high pressure (discharge pressure) acts upon the lubricating oil 14 to permit the lubricating oil 14 to be readily fed to sliding portions in the compressor by centrifugal pump action, thereby enabling improving the sealing quality of the working chambers and the lubrication of the sliding portions.

Although explanation has been given to the above-mentioned embodiments, in which the number of the spiral bodies defining the outer peripheral surface shape of the orbiting piston 31 and the inner peripheral surface shape of the cylinder 29 is three, they can be applied to the self-rotation preventing mechanism 33, the pressure equalizing holes 29*e,* 32*d,* and the inclined flow passages 29*g,* in which a practical number (2 to 10) of the spiral bodies is involved.

Further, the compression element 27 of this embodiment has been disclosed, in which the pin type self-rotation preventing mechanism 33 is used. However, various self-rotation preventing mechanisms such a crank pin type, an Oldham's key type or a ball coupling type may be used depending upon the configuration of the compression element with the number of the spiral bodies practical.

Figure 12:
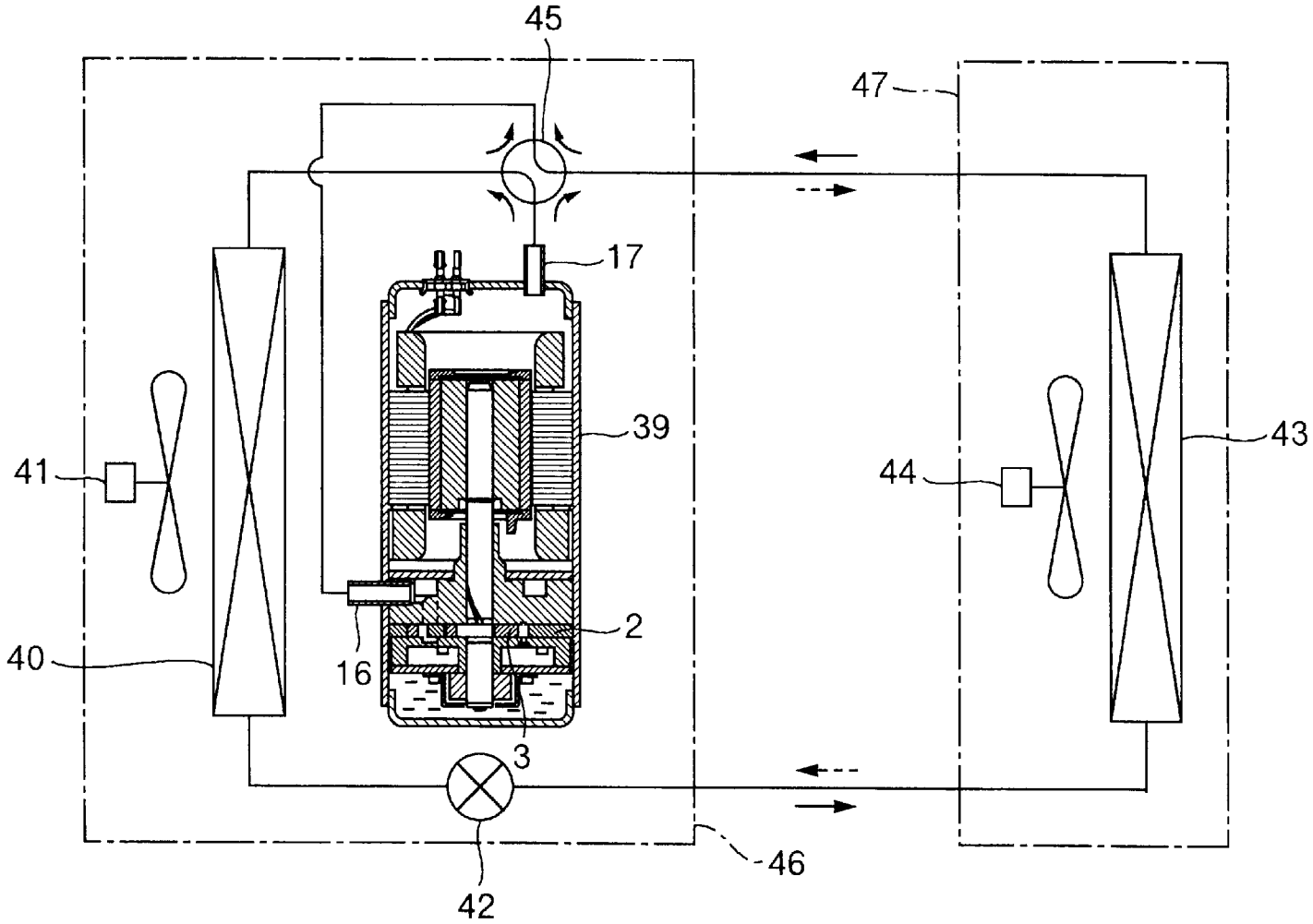
FIG. 12 is a view illustrating an air-conditioning system, to which a displacement type compressor according to an embodiment of the present invention is applied.

FIG. 12 shows an air-conditioning system incorporating thereinto a displacement type compressor according to the present invention. The air-conditioning system employs a heat pump cycle which enables cooling and heating, and comprises the displacement type compressor 39 according to the present invention, as described with reference to FIG. 3, an outdoor heat-exchanger 40 with a fan 41, an expansion valve 42, an indoor heat-exchanger 43 with a fan 44, and a four-way valve 45. An outdoor unit 46 and an indoor unit 47 are indicated by one-dot chain lines. The displacement type compressor 39 is operated based upon the operating principle shown in FIGS. 2A to 2D such that when the displacement type compressor 39 is started, a working fluid (for example, fleon HCF"" or R410A) is compressed between the cylinder 2 and the orbiting piston 3.

In the case of cooling operation, the compressed working fluid having a high temperature and a high pressure flows from the discharge pipe 17 into the outside heat-exchanger 40 through the four-way valve 45, and is then subjected to heat-radiation and liquefaction by the action of the fan 41. The working fluid is then throttled by the expansion valve 43 to undergo adiabatic expansion to become low in temperature and pressure. Then, the working fluid absorbs heat from the room through the indoor heat-exchanger 43 to be gasified, and then it is sucked into the displacement type compressor 39 through the suction pipe 16. Meanwhile, in the case of heating operation, the working fluid flows in a direction reverse to that in the case of cooling operation, as shown by arrows of broken line, and the compressed working gas having a high temperature and a high pressure flows from the discharge pipe 17 into the indoor heat-exchanger 43 through the four-way valve 44 to undergo heat radiation by the blowing action of the fan 44. Thus, the working gas is liquefied, and is then throttled by the expansion valve 42 to undergo adiabatic expansion to become low in temperature and pressure. Then, it absorbs heat from the ambient air in the outdoor heat-exchanger 40 to be gasified, and is then sucked into the displacement type compressor 39 through the suction pipe 16.

Figure 13:
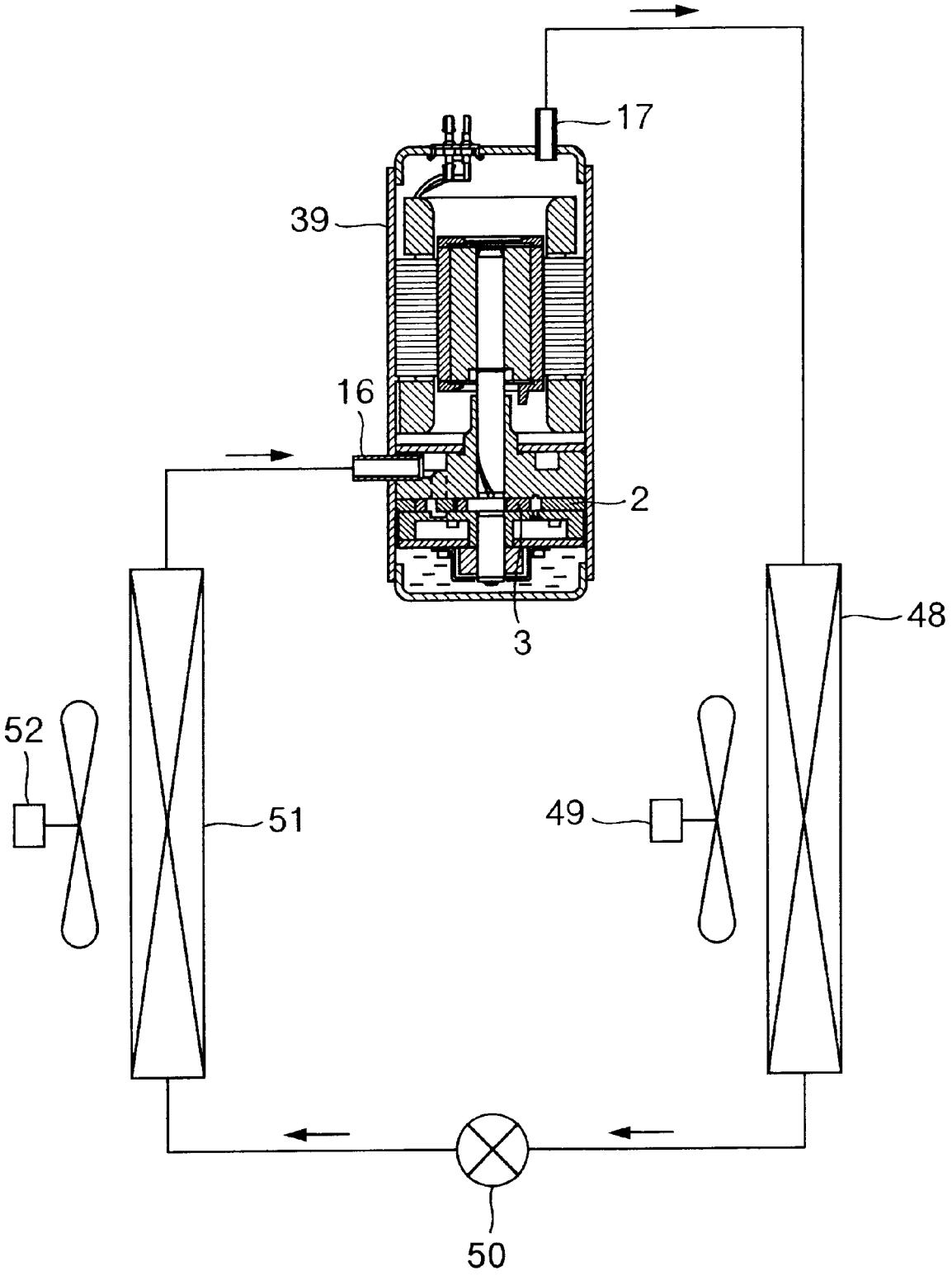
FIG. 13 is a refrigerating system, to which a displacement type compressor according to an embodiment of the present invention is applied.

FIG. 13 shows a refrigerating system incorporating thereinto the orbiting type compressor according to the present invention. The system employs an exclusive refrigerating (cooling) cycle. Referring to this figure, there are shown a condenser 48, a condenser fan 49, an expansion valve 50, an evaporator 51 and an evaporator fan 52.

When the displacement type compressor 39 is started, the working fluid is compressed between the cylinder 2 and the orbiting piston 3, and the compressed working gas having a high temperature and a high pressure flows into the condenser 48 through the discharge pipe 17 as shown by arrows of solid line, and performs heat radiation and liquefaction by the blowing action of the fan 49. Then it is throttled by the expansion valve 50 to undergo adiabatic expansion to become low in temperature and pressure, and absorbs heat and gasifies in the evaporator 51 before it is sucked into the displacement type compressor 39 through the suction pipe 16. Incidentally, a refrigerating/air-conditioning system which is excellent in energy efficiency, which involves low vibrations and noises, and which is highly reliable, is obtained since the both systems shown FIGS. 12 and 13 incorporate the displacement type compressor 39 according to the present invention. Although the displacement type compressor 39 has been described as being of a high pressure type, the displacement type compressor of a low pressure type can also function in a similar manner and provide similar technical effects. Further, the use of the displacement type compressor 39 according to the present invention dispenses with a silencer and the like, thereby enabling reducing the cost.

Figure 14:
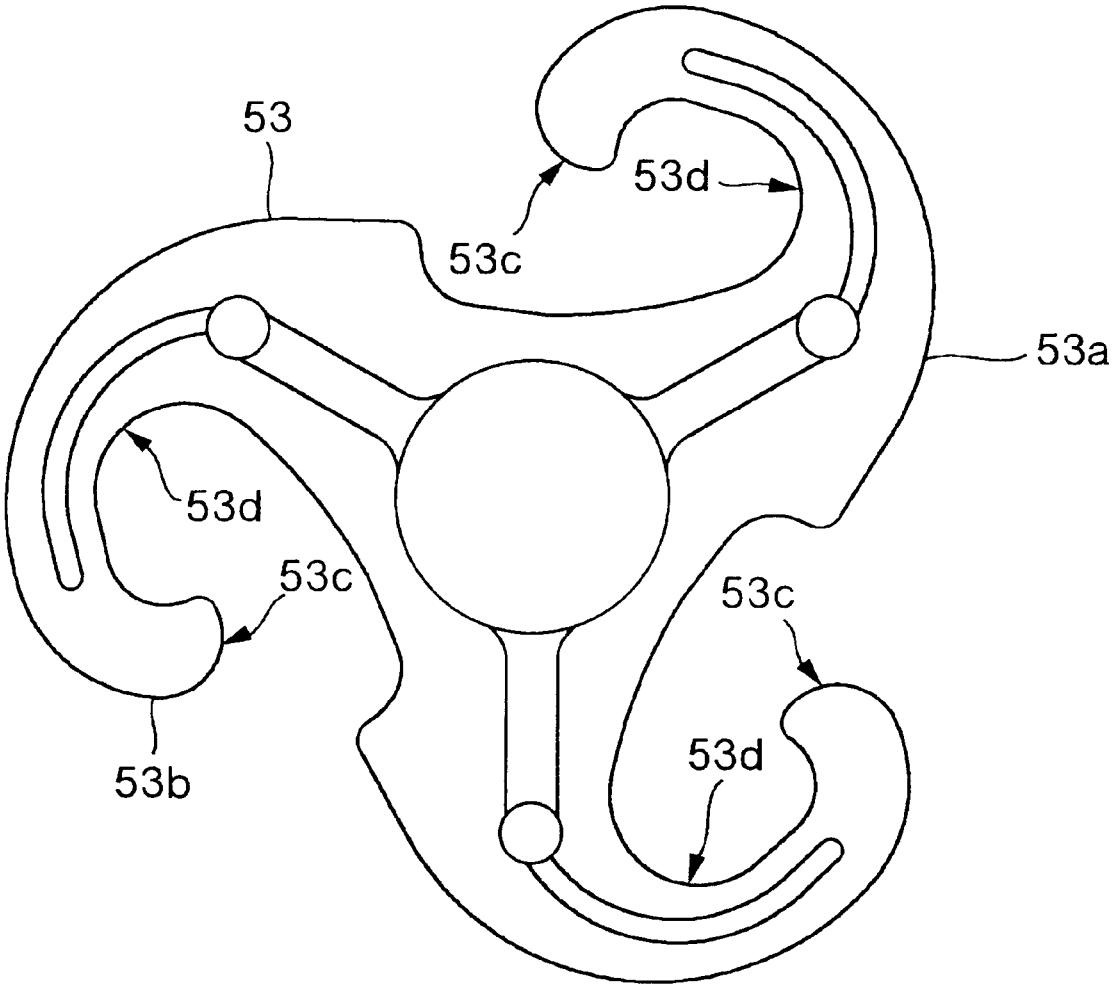
FIG. 14 is a plan view illustrating an orbiting piston according to the present invention.

FIG. 14 is a plan view illustrating an orbiting piston 53 according to the embodiment of the present invention. The orbiting piston 53 has three spiral laps in which three contour are combined. The outer peripheral shape of the orbiting piston 53 is such that counterclockwise wrap outer peripheral walls 53*a* appear at every 120 degrees (around the center o'). The individual counterclockwise wrap outer peripheral wall 53*a* is provided at its end with a plurality (three in this case) of arcuate vanes 53*b* which project inward. In the case where the orbiting piston 53 engages with the cylinder, which constitutes the compression element, curvatures of outer peripheral walls 53*c*, 53*d* of the orbiting piston 53 become greater than that of ideal curves. With this arrangement, it is possible to prevent the orbiting piston 53 from rotating around the center due to a load caused by a self-rotating moment. As a result, radial gaps at engaging contact points between the orbiting piston 53 and the cylinder, which constitutes the compression element, can be maintained at optimum values to provide a closed type compressor having a high efficiency. Incidentally, the curvatures of outer peripheral walls 53*c*, 53*d* are determined from the gaps at the engaging contact points between the orbiting piston 53 and the cylinder, which constitutes the compression element.

Further, the outer peripheral wall of the orbiting piston 53 may be subjected to surface treatment which is excellent in sliding quality, and heat-treatment, whereby it is possible to provide a closed type compressor which is excellent in reliability.

With the above arrangement, if the center of the orbiting piston 53 is made to correspond to the center of the cylinder, their contours are not similar as shown in FIG. 1.

As mentioned above, the structure of the orbiting piston 53 in this embodiment is applicable on the orbiting piston 53, which involves a practical number (2 to 10) of spiral bodies.

Figure 15:
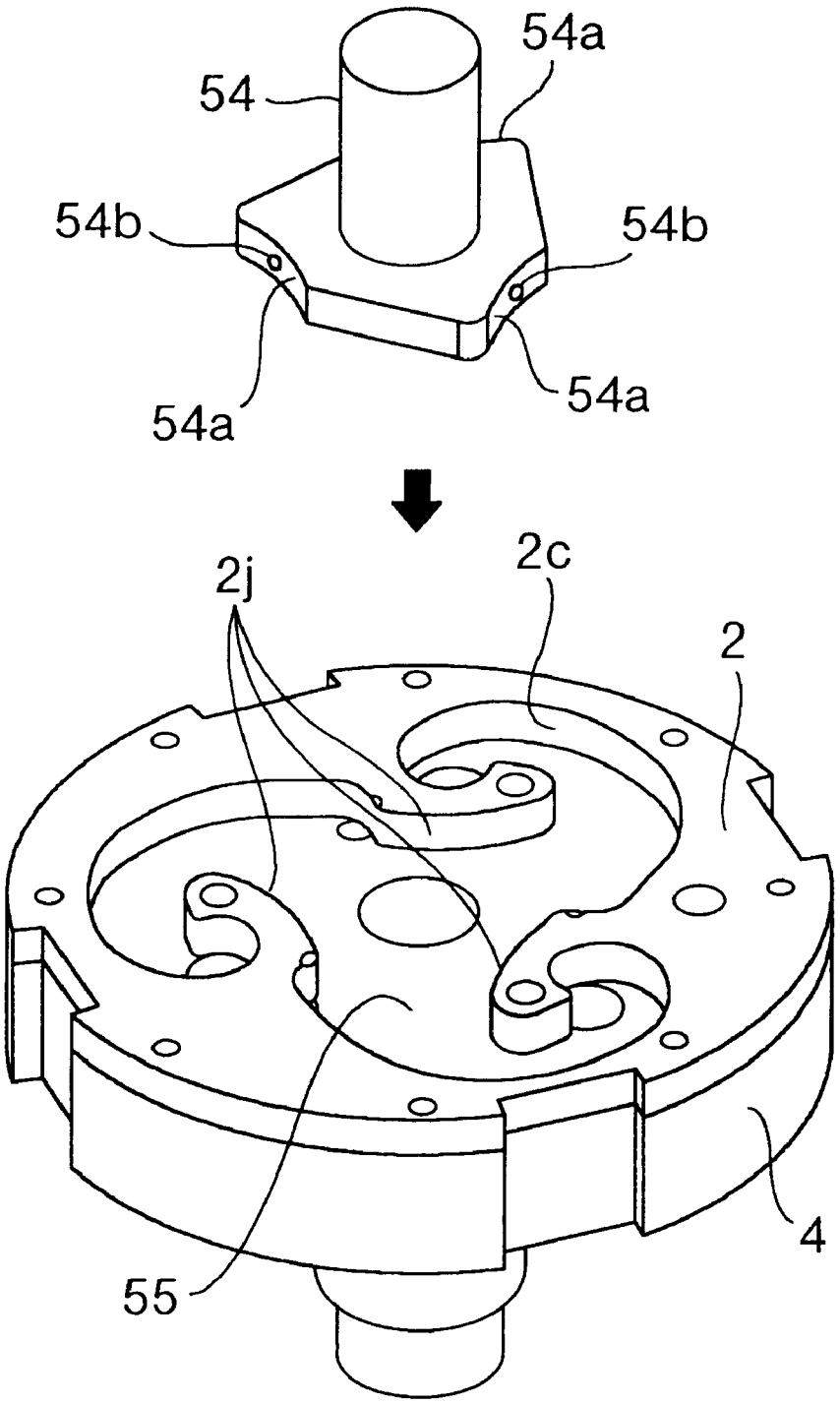
FIG. 15 is a view illustrating a method of assembling an orbiting type compression element according to the present invention.

Next, explanation will be made of a method of assembling a compression element according to the embodiments of the present invention. Referring to FIG. 15 which is an explanatory view for this method, when the main bearing 4 is to be mounted to the cylinder 2 temporarily, an assembling jig 54 including three arcuate portions 54*a* having smaller curvatures than those of arbitrary concentric circles 2*j* (three are present in the three spiral laps in this embodiment) of three spiral bodies constituting the inner peripheral wall 2*c* of the cylinder 2 is inserted into a space, into which the orbiting piston is inserted. The assembling jig 54 is provided at its three arcuate portions 54*a* with three sensors 54*b* for measuring radial gaps. The assembling jig 54 is inserted into the space 55, and the cylinder 2 is mounted to the main bearing 4 temporarily at such a position (centers of three circles) that values measured by the three sensors 54*b* become equal to one another, thereby enabling accurate positioning. At this time, setting of the radial gaps is determined in accordance with dimensional tolerances for the outer peripheral wall of the orbiting piston, the inner peripheral wall 2*c* of the cylinder 2 and the eccentric portion of the drive shaft. It is noted that this embodiment can be applied to the case where the cylinder 2 disclosed in FIG. 3 is independent from the main bearing 4 journalling the drive shaft 6.

Further, although explanation has been given to the case that the number of spiral bodies which define the outer peripheral surface shape of the orbiting piston and the inner peripheral surface of the cylinder is three in this embodiment, the above assembling method can be applied to the case that the number of spiral bodies is practical (2 to 10).

As detailed above, according to the present invention, more than two working chambers are arranged around the drive shaft, each of which has a shaft rotating angle of substantially 360 degrees from the completion of suction to the completion of discharge, and the pressure equalizing holes are arranged in such a manner to greatly reduce excessive compression loss during discharge, so that it is possible to provide a displacement fluid machine which ensures stable behavior for the orbiting piston, and which can enhance the performance, and which is highly reliable. Further, such an orbiting type fluid machine is incorporated in a refrigerating cycle to provide a refrigerating/air-conditioning system which is excellent in energy efficiency and highly reliable.

What is claimed is:

1. In a displacement fluid machine, which includes a displacer, a cylinder, end plates with the displacer and the cylinder arranged therebetween, and a drive shaft, and in which an inner wall surface of the cylinder and an outer wall surface of the displacer define therebetween one space when a center of the displacer is made to correspond with an axis of rotation of the drive shaft, and a plurality of spaces are defined therebetween when the displacer and the cylinder are located in an orbit position, a first of said end plates including a plurality of suction ports, the improvement comprising means for supplying a lubricating oil to surfaces of said displacer opposed to said end plates, and holes formed in a second of said end plates opposite to said first end plate formed with suction portions, said holes being provided at positions in the second end plate corresponding to positions in said first end plate at which said suction ports are provided.

2. The displacement fluid machine according to claim 1, wherein one of said end plates is formed integrally on a main-bearing and another of said end plates is formed integrally on a sub-bearing.

3. In a displacement fluid machine, which includes a displacer, a cylinder, end plates with the displacer and the cylinder arranged therebetween, and a drive shaft, and in which an inner wall surface of the cylinder and an outer wall surface of the displacer define therebetween one space when a center of the displacer is made to correspond with an axis of rotation of the drive shaft, and a plurality of spaces are defined therebetween when the displacer and the cylinder are located in an orbit position, a first of said end plates including a plurality of discharge ports, the improvement comprising means for supplying a lubricating oil to surfaces of said displacer opposed to said end plates, and holes formed in a second of said end plates opposite to said first end plate formed with discharge portions, said holes being provided at positions in the second end plate corresponding to positions in said first end plate at which said discharge ports are provided.

4. The displacement fluid machine according to claim 3, wherein one of said end plates is formed integrally on a main-bearing and another of said end plates is formed integrally on a sub-bearing.

5. In a displacement fluid machine, which includes a displacer, a cylinder, end plates with the displacer and the cylinder arranged therebetween, and a drive shaft, and in which an inner wall surface of the cylinder and an outer wall surface of the displacer define therebetween one space when a center of the displacer is made to correspond with an axis of rotation of the drive shaft, and a plurality of spaces are defined therebetween when the displacer and the cylinder are located in an orbit position, a first of said end plates including a plurality of discharge ports, and a second of said end plates including a plurality of suction ports, the improvement comprising means for supplying a lubricating oil to surfaces of said displacer opposed to said end plates, and holes formed in said first of said end plates opposite to said second end plate formed with suction portions, said holes being provided at positions in the first end plate corresponding to positions in said second end plate at which said suction ports are provided, and holes formed in said second of said end plates opposite to said first end plate formed with discharge ports, said holes being provided at positions in the second of said end plates corresponding to positions in said first end plate at which said discharge ports are provided.

6. The displacement fluid machine according to claim 5, wherein one of said end plates is formed integrally on a main-bearing and another of said end plates is formed integrally on a sub-bearing.

* * * * *